US007300367B1

(12) United States Patent
Andol et al.

(10) Patent No.: US 7,300,367 B1
(45) Date of Patent: Nov. 27, 2007

(54) SYSTEM FOR TRACKING WILD GAME

(75) Inventors: Mark Steven Andol, Cowlesville, NY (US); Edwin G. Pierrot, Eden, NY (US); James R. Pierrot, Elma, NY (US); Robert R. Simmons, Santa Barbera, CA (US)

(73) Assignees: General Welding and Fabricating, Inc., Elma, NY (US); Balboa Engineering, Inc., Eden, NY (US)

( * ) Notice: Subject to any disclaimer, the term of this patent is extended or adjusted under 35 U.S.C. 154(b) by 0 days.

(21) Appl. No.: 11/336,661

(22) Filed: Jan. 20, 2006

Related U.S. Application Data

(60) Provisional application No. 60/645,189, filed on Jan. 20, 2005.

(51) Int. Cl.
*F42B 6/04* (2006.01)

(52) U.S. Cl. ..... 473/578; 342/385; 455/98

(58) Field of Classification Search ..... 342/385, 342/386; 455/98; 473/578, 582
See application file for complete search history.

(56) References Cited

U.S. PATENT DOCUMENTS

| | | | | |
|---|---|---|---|---|
| 3,790,948 | A | 2/1974 | Ratkovich | |
| 4,651,999 | A | 3/1987 | Sturm | |
| 4,675,683 | A | 6/1987 | Robinson et al. | |
| 4,704,612 | A | 11/1987 | Boy et al. | |
| 4,851,775 | A | 7/1989 | Kim et al. | |
| 4,858,935 | A | 8/1989 | Capson | |
| 4,940,245 | A * | 7/1990 | Bittle, Jr. | 473/570 |
| RE33,470 | E | 12/1990 | Boy et al. | |
| 4,976,442 | A | 12/1990 | Treadway | |
| 5,188,373 | A | 2/1993 | Ferguson et al. | |
| 5,239,264 | A | 8/1993 | Hawks | |
| 5,289,163 | A * | 2/1994 | Perez et al. | 340/539.32 |
| 5,446,467 | A | 8/1995 | Willett | |
| 5,450,614 | A | 9/1995 | Rodriguez | |
| 6,055,761 | A | 5/2000 | Chaprales | |
| 6,409,617 | B1 | 6/2002 | Armold | |
| 6,612,947 | B2 | 9/2003 | Porter | |
| 6,828,907 | B1 * | 12/2004 | Galle | 340/539.11 |
| 6,856,250 | B2 * | 2/2005 | Hilliard | 340/573.2 |
| 2002/0091023 | A1 | 7/2002 | Porter | |

OTHER PUBLICATIONS

"'After the Shot' . . . Recover your Trophy with Trackmaster," avertisement of Trackmaster, Bowhunting World magazine, Oct. 1999, p. 80.

"Application Note: Discrete Circuit for Magneto-Inductive Sensors," brochure 1000083 R02 of PNI Corporation, 2003, pp. 1-5.

* cited by examiner

*Primary Examiner*—John A. Ricci
(74) *Attorney, Agent, or Firm*—James C. Simmons

(57) ABSTRACT

An assembly for tracking an animal which has been shot by an arrow. A shank portion of an arrow is received in a bushing which in turn receives a housing for a transmitter. The housing is retained on the bushing during arrow flight by an elastomeric ring. Upon impact of the arrow with the animal, the elastomeric ring is dislodged, releasing the housing from the bushing. Associated with the housing are members which penetrate the animal to attach the housing to the animal. A hand-held direction finding receiver receives signals from the transmitter so that direction to the animal is determined.

20 Claims, 24 Drawing Sheets

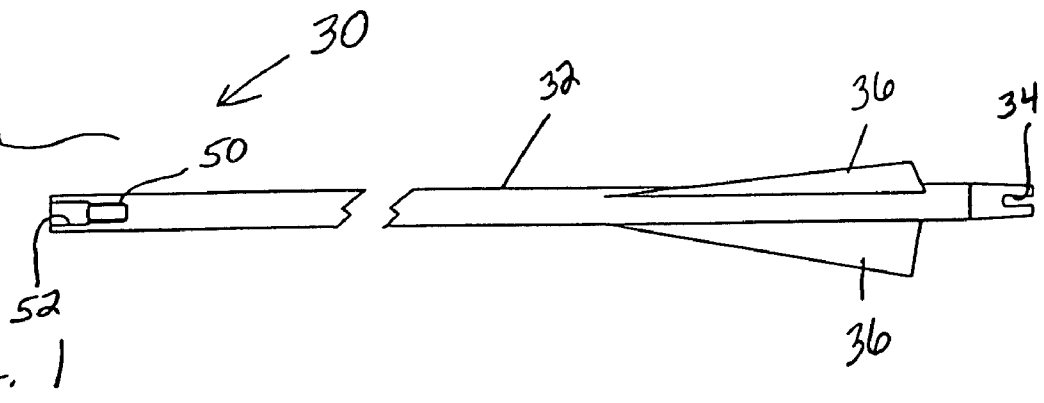
FIG. 1
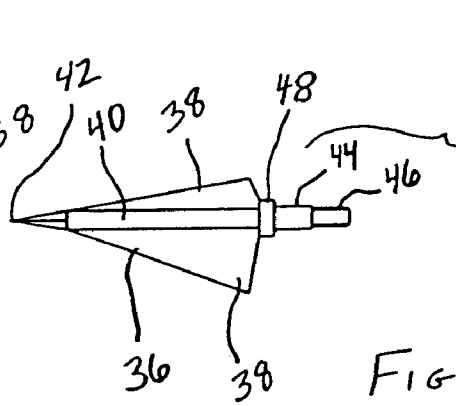
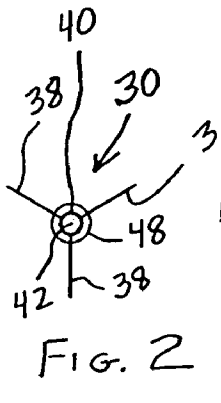
FIG. 2

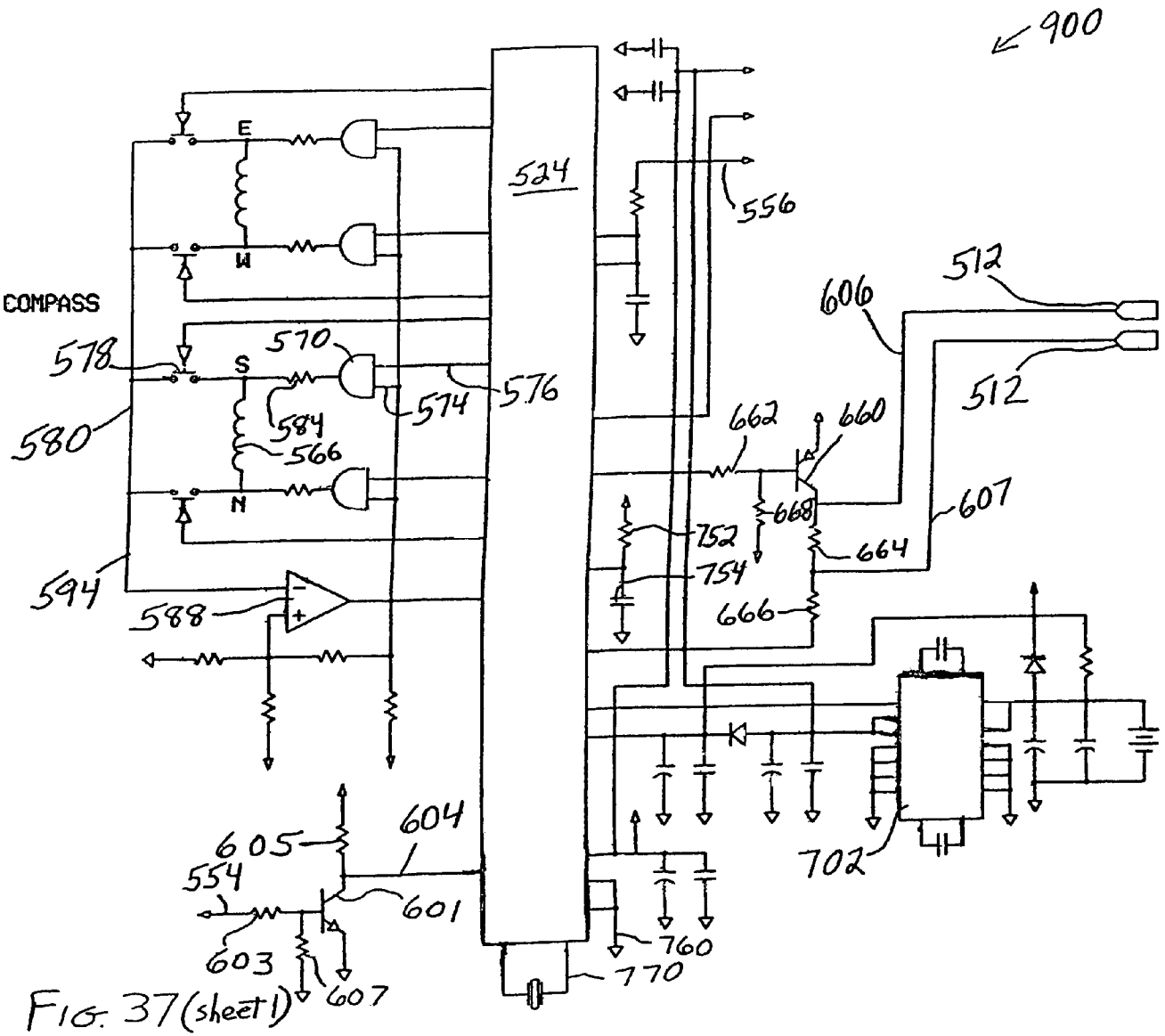
FIG. 37 (sheet 1)

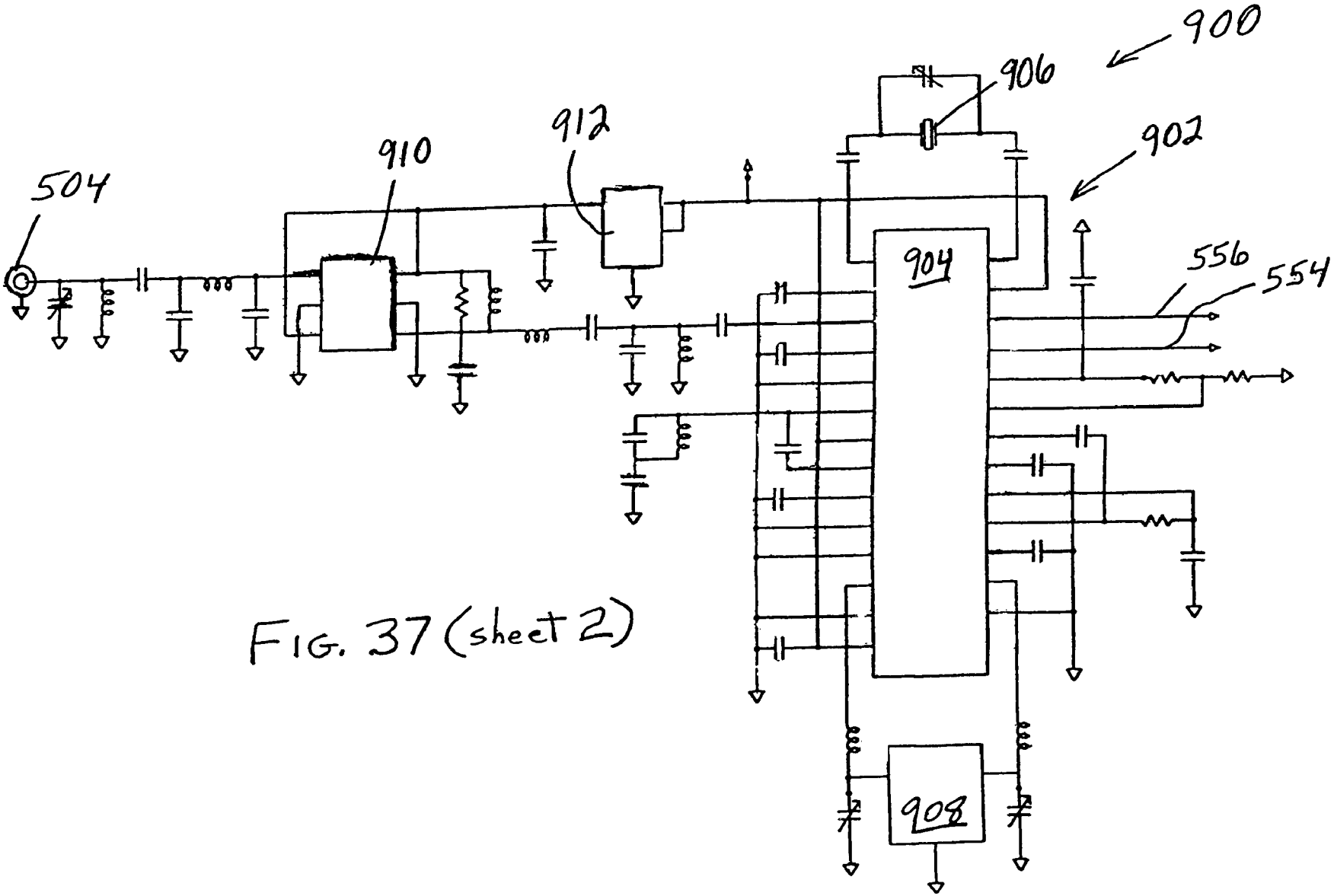
FIG. 37 (sheet 2)

SYSTEM FOR TRACKING WILD GAME

Priority of U.S. provisional patent application Ser. No. 60/645,189, filed Jan. 20, 2005, the disclosure of which is incorporated herein by reference, is hereby claimed.

The present invention relates generally to the hunting, tracking, and tagging of deer or other wild game. More particularly, the present invention relates to a system for tracking deer or other wild game, including the tracking of wild game which has been wounded by an arrow or tagged with a dart. While the present invention will be described with respect to hunting wild game with an arrow, it should be understood that it is also applicable to the tagging of animals such as elephants. Thus, the term "arrow," as used herein and in the claims, is meant to include darts or similar instruments for hunting, tagging, or tracking animals.

A deer or other wild game may travel a long distance after it has been shot with an arrow, and it may be difficult to track the wounded animal. The blood trail, a common means of tracking, may be difficult to follow due to, for example, rugged terrain, washing away of the blood by rain or the traveling of the animal through water, clotting of the blood, or the leaving of no blood trail at all due to only internal bleeding. As a result of the difficult tracking, the wounded animal is often lost and never retrieved.

Many attempts have been made to provide means such as transmitters attached to the arrows for tracking deer wounded by the arrows, including the devices disclosed in U.S. Pat. Nos. Re. 33,470 (reissue of U.S. Pat. No. 4,704,612); 3,790,948; 4,651,999; 4,675,683; 4,858,935; 4,976,442; 5,188,373; 5,446,467; 5,450,614; 6,055,761; 6,409,617; and 6,612,947. The transmitter sends signals, for the purpose of determining the location thereof, to a receiver held by the hunter. While the receiver in U.S. Pat. Re. 33,470 is described as being a radio-frequency receiver having a directional antenna and a magnitude indicator and earphone coupled thereto, in many receivers of the prior art, the receiver has no compass or display and essentially acts like a Geiger counter, i.e., it simply beeps louder and softer.

U.S. Pat. No. 5,188,373 to Ferguson et al discloses an arrow wherein a transmitter (for transmitting signals to a receiver) is releasably attached by tape, which is described as "having sufficient bonding or shear strength to maintain the transmitter affixed to the arrow in view of the forces applied to the transmitter when the arrow is shot, but not sufficient to withstand the impact of the transmitter against the hide of the target animal." The transmitter is provided with barbs to secure the transmitter to the hide of the target animal. Such a device has an adverse impact on arrow balance and undesirably requires the application of the tape in order to prepare the arrow with the transmitter attached for use. Also disclosed is a transmitter device releasably secured within the arrow by an undesirably complex spring arrangement. This alternative device, in addition to having an adverse impact on arrow balance, undesirably requires that the arrow shaft be altered to receive the transmitter therein.

U.S. Pat. No. 5,446,467 to Willett discloses an arrow wherein a sender unit (for transmitting signals to a receiver) is mounted in a bracket which is secured to the arrow between the broadhead and the shaft, with a balancing weight provided on the other side. When the arrow hits, the sender unit, with a dart, snaps out of the bracket and into the game. This device, although it provides for a counterbalance of weight, does not allow for aerodynamic balancing. Wind resistance caused by the transmitter body may cause excessive drag on one side of the arrow, resulting in erratic arrow flight and rotation that will reduce accuracy and distance. In addition, the transmitter holder creates a problem with initial arrow penetration. Thus, if the arrow is fired at an angle and the transmitter is trapped between the body of the target and the arrow shaft, the transmitter may not release its holder. The failure of this release will stop the arrow from penetrating its intended target and bounce off, leaving a non-lethal flesh wound. Even when the transmitter deploys, the holder will still create a drag on the flesh as it enters the target, reducing the arrow's momentum and increasing the likelihood of a non-lethal wound. Moreover, the bracket is made of spring steel, which is disclosed as "designed to release the electronic sender device when it strikes the target." However, it is not disclosed in Willett how the device is detachably attached to the spring steel bracket.

U.S. Pat. No. 4,976,442 to Treadway discloses an arrow having a notch or slot in which a transmitter (for transmitting signals to a receiver) fits, the transmitter provided with a curved hook which terminates in a sharp hook tip having a barb. The hook tip and barb are designed to project through the slot or notch in the arrow shaft and engage and remain in the animal when the arrow strikes the animal, wherein the force of the strike causes the transmitter to exit the notch in the arrow shaft and remain in the animal, regardless of the arrow location. This device, in addition to having an adverse impact on arrow balance, undesirably requires that the arrow shaft be altered by the placement of the notch therein.

Each of the above patents suffers from one or more infirmities. In many of these patents, the transmitter remains within a hollow shaft portion or otherwise attached to the arrow with the result that the deer cannot be tracked if the arrow passes entirely through the deer. The attachment of the transmitter device in many of the above patents has a detrimental impact on arrow balance or undesirably requires the arrow shaft to be altered by the forming of a notch or the like therein.

It is accordingly an object of the present invention to provide a system for tracking wild game wherein a transmitter device is attached to an arrow so that it detaches therefrom and attaches to the animal when the arrow strikes the animal, wherein the device is suitably balanced on the arrow and does not require altering of the arrow for attachment of the device.

It is another object of the present invention to provide such a transmitter device which is light in weight and compact.

It is a further object of the present invention to provide a compact receiver to act as a direction finder for the transmitter.

In order to provide such a system, in accordance with the present invention, there is provided an assembly comprising a transmitter to be carried by an arrow for effecting embedding of said transmitter into an animal struck by the arrow, said transmitter adapted to transmit signals to a receiver for tracking the animal, the assembly further comprising a bushing attachable to the arrow and having an outer surface and a groove in and circumscribing said outer surface, a housing for said transmitter, said housing having an inner surface adapted to circumscribe said bushing outer surface adjacent said groove, an elastomeric ring removably received in said groove and having a size and strength to hold said housing on said bushing during flight of the arrow and to dislodge from said groove and thereby release said housing from said bushing during impact of the arrow with the animal, the assembly further comprising at least one member for penetrating the animal for attaching the housing to the animal.

The above and other objects, features, and advantages of the present invention will be apparent in the following detailed description of the preferred embodiment thereof when read in conjunction with the accompanying drawings wherein the same reference numerals depict the same or similar parts throughout the several views.

BRIEF DESCRIPTION OF THE DRAWINGS

FIG. 1 is a side exploded view of a typical arrow on which a transmitter assembly embodying the present invention is mountable.

FIG. 2 is an end view of the broadhead of the arrow of FIG. 1.

FIG. 9 is a plan view (rear side) of a housing for the transmitter assembly.

FIG. 10 is a plan view (rear side) of a circuit board for the transmitter assembly.

FIG. 37 is a view similar to that of FIG. 24 of an alternative embodiment of the receiver circuit.

DETAILED DESCRIPTION OF THE PREFERRED EMBODIMENT

Figure 3:
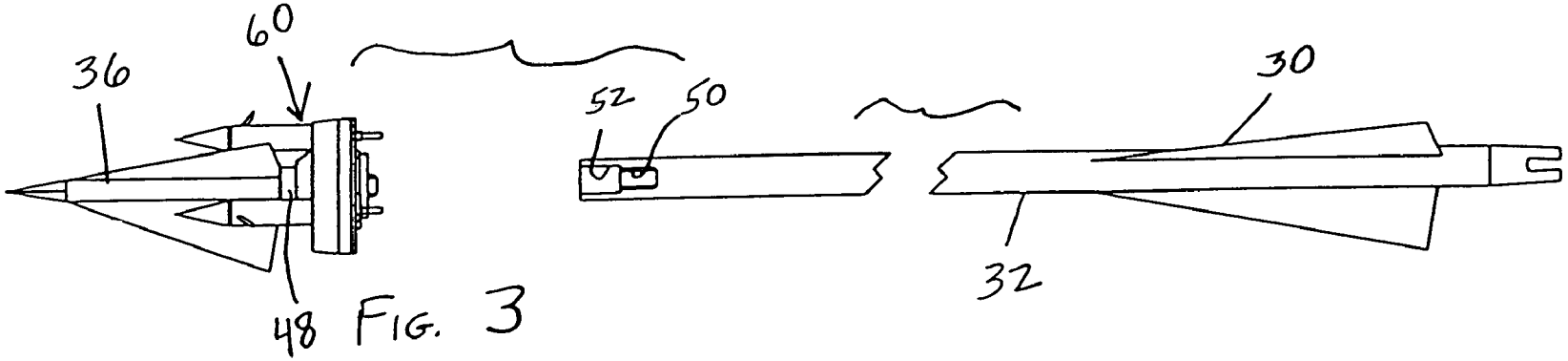
FIG. 3 is a view similar to that of FIG. 1 of the arrow with a transmitter assembly embodying the present invention attached.
Figure 4:
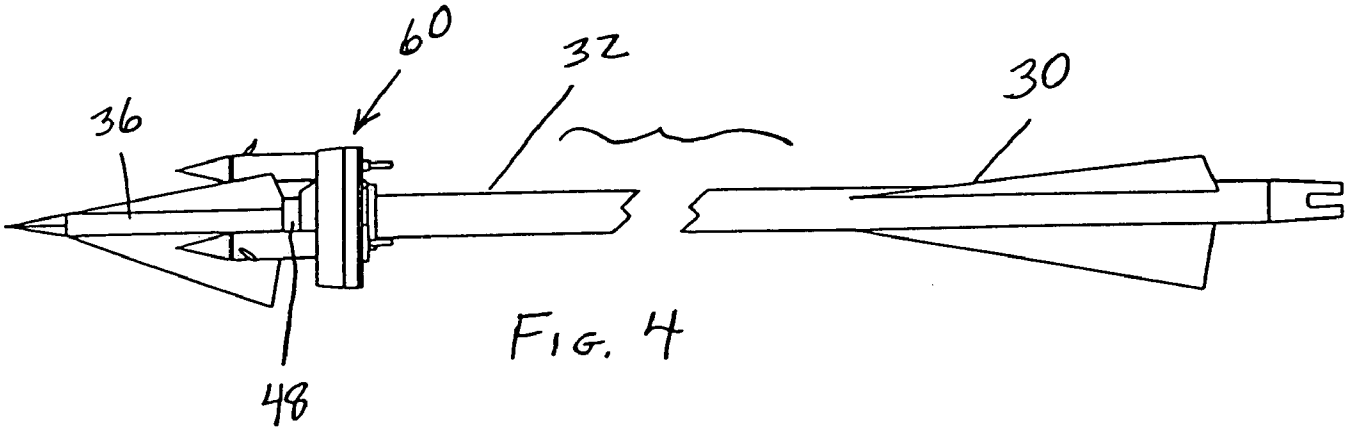
FIG. 4 is a side unexploded view of the arrow with the transmitter assembly attached.
Figure 5:
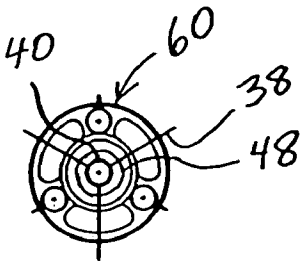
FIG. 5 is a view similar to that of FIG. 2 of the arrow with the transmitter assembly attached.

Referring to FIGS. 1 and 2, there is illustrated generally at 30 a typical arrow with which the present invention may be used. For a cross bow, the arrow is called a "bolt," and the present invention is also applicable to bolts. Thus, the term "arrow," as used herein and in the claims, is meant to include bolts as used in a cross bow as well as darts and the like, as previously discussed. The arrow 30 is typically used to hunt deer or other wild game. The arrow 30 includes a shaft 32 having a bow string notch 34 in one end and fins 36 (feather members or the like) adjacent thereto for guiding the arrow aerodynamically. The other end of the shaft 32 is attached to a broadhead 36 which has a number of, for example, 3 blades 38 emanating from a shaft portion 40 which terminates in a sharp point, illustrated at 42, for piercing a target animal. The shaft portion 40 extends rearwardly beyond the rear ends of the blades 38 to define a shank portion 44 (having a length of, for example, about ¼ inch) which terminates in a threaded end portion 46 (having a length of, for example, about ⅜ inch). As used herein and in the claims, the term "forward" and variants thereof is meant to refer to a position ahead of another object with reference to a direction in which the arrow is aimed, and the term "rearward" and variants thereof is meant to refer to a position behind another object with reference to a direction in which the arrow is aimed. Thus, the arrow shaft 32 is rearward of the broadhead 36. On the shank portion 44 adjacent the ends of the blades 38 is a collar 48, which may be an enlarged part of the shank portion 44 or a separate piece. The arrow shaft 32 has an internally threaded bore 50 for threadedly receiving the threaded portion 46 and a counterbore 52 for receiving the shank portion 44 for attaching the broadhead 36 to the shaft 32. The shank portion 44 and the counterbore 52 may each have a length of, for example, about ¼ inch, and the threaded portion 46 and threaded bore 50 may each have a length of, for example, about ⅜ inch, the bore 50 and counterbore 52 being slightly longer than the respective portions 46 and 44 to prevent bottoming out. Thus, for use of the arrow without the present invention, the broadhead 36 is screwed onto the shaft 32 and tightened with the collar bearing against the end of the shaft 32.

Referring to FIGS. 3 to 7, there is illustrated the arrow 30 with a transmitter assembly, illustrated generally at 60, attached thereto, the transmitter assembly including a housing or support ring 64 releasably secured to a release bushing 62, as described hereinafter. The bushing 62 is fixedly (securely) attached to the arrow 30, as described hereinafter.

The bushing 62 has a cylindrical wall portion 66 open at one end thereby defining a passage or bore, illustrated at 68, for receiving the forward end portion of the arrow shaft 32. A wall portion 70 closes the other end of the bushing 62, the wall portion 70 having a bore 72 there through for receiving the broadhead shank portion 44. In order to fixedly attach the bushing to the arrow 30, the shaft 32 is received in the bore 68, the shank 44 is received through the bore 42, and the threaded portion 46 is threadedly received in the threaded bore 50 and tightened to squeeze the bushing wall portion 70 between the collar 48 and the end of the arrow shaft 32. The bushing wall portion 70 may have a thickness of, for example, about 1/16 inch. The portion 44 and counterbore 52 each may typically have a length of about ¼ inch. The threaded bore 50 (as well as threaded portion 46) typically has a length of about ⅜ inch, and it is believed that a thread engagement over the resulting decreased length of about 5/16 inch (still being roughly about 1½ times the #832 thread diameter) is satisfactory. However, if necessary or desirable, the length of threaded bore 50 may be increased by, for example, about 1/16 inch. Various exemplary dimensions and materials and the like contained herein, unless recited in the claims, are for exemplary purposes only and not for purposes of limitation.

Figures 15, 16:
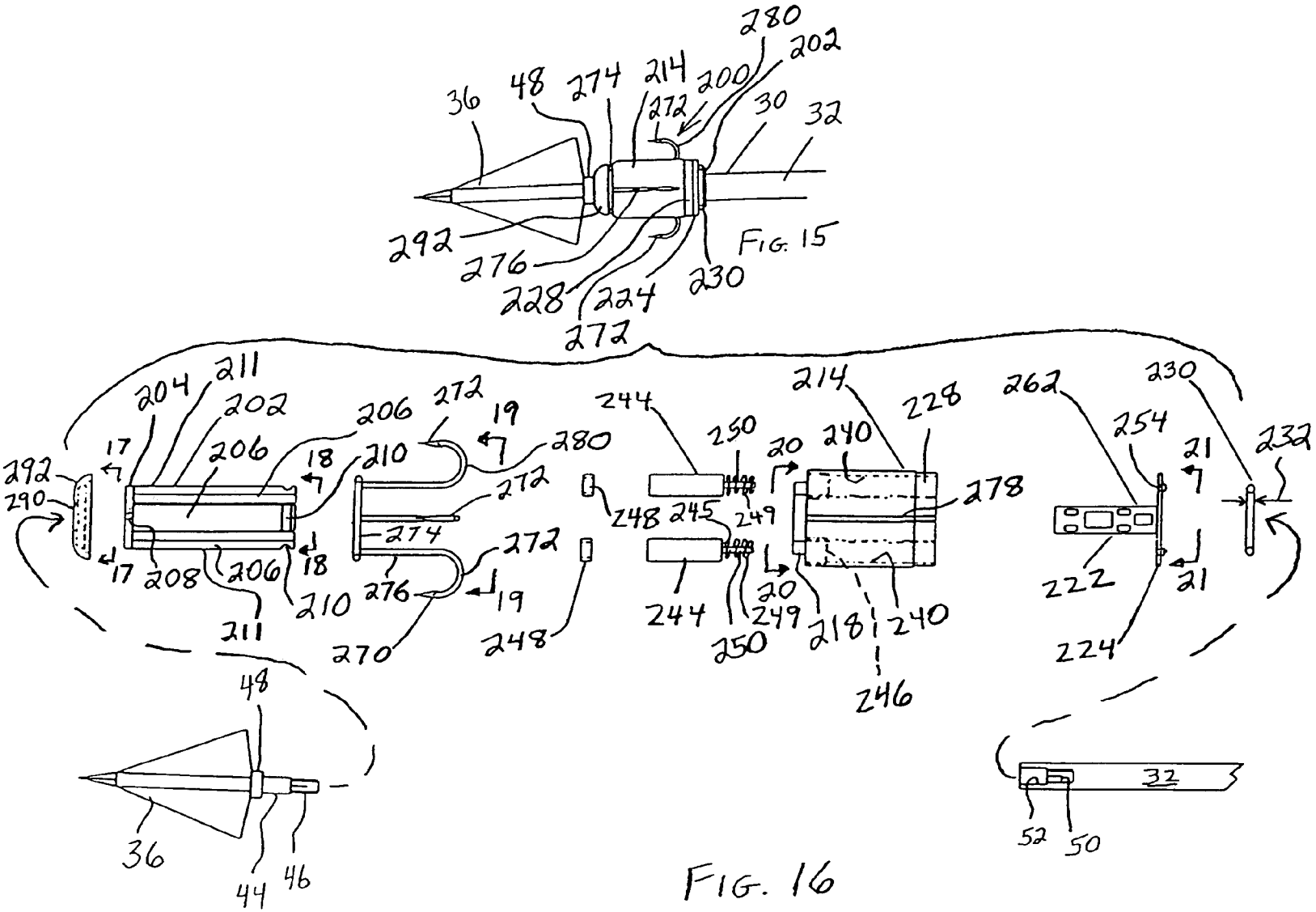
FIG. 15 is a partial side view of an arrow with a transmitter assembly in accordance with an alternative embodiment of the present invention attached thereto.
FIG. 16 is an exploded view thereof.
Figure 17:
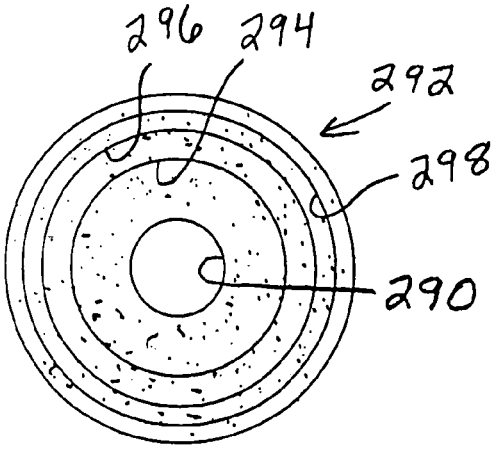
FIG. 17 is a view of the transmitter cap therefor, taken along lines 17-17 in FIG. 16.

For the purposes of this specification and the claims, a "bushing" is defined as a member having a passage in which a shank portion of an arrow is receivable whereby the bushing is fixedly attached to the arrow. A bushing may have various shapes such as shown at 62 in FIG. 7 and at 202 in FIG. 16.

Figure 7:
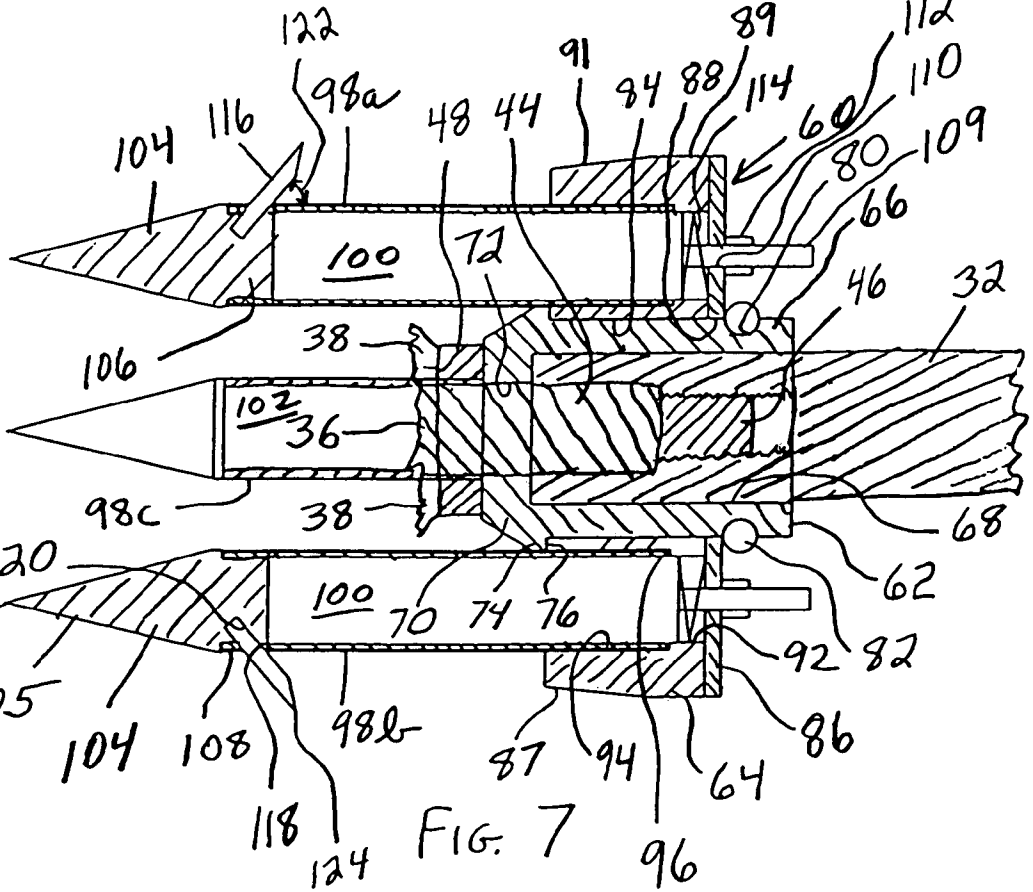
FIG. 7 is a section view, taken along lines 7-7 of FIG. 6, of the transmitter assembly and illustrating the attachment of the transmitter assembly to the arrow.

The forward end portion (at or adjacent the wall portion 70) of the bushing 62 has an increased diameter portion 74, which is shaped to define, rearwardly thereof, a shoulder 76, and has a short cylindrical portion 78 extending forwardly from the shoulder 76. The forward end portion of the bushing 62 has a truncated conical surface extending forwardly from the short cylindrical portion 78 to the forward surface of wall portion 70. Adjacent the rear end of the bushing 62 is a groove 80 in the outer bushing surface which groove circumscribes the bushing 62. An elastomeric ring 82, i.e., an o-ring or the like, is received in groove 80. A transmitter circuit board 86, described in greater detail hereinafter, is attached to the rear surface of the housing 64 by suitable means such as by bonding, an example of a suitable bonding agent being Permabond #2011 adhesive manufactured by Permabond LLC of Somerset, N.J. The housing or support ring 64 is generally cylindrical in shape and has a bore 84 extending axially there through and defining a radially inner surface the diameter of which is substantially equal to the diameter of the bushing radially outer surface but with some slack to allow the housing 64 to easily slide axially along and off of the bushing 62. A similar bore 88 is provided in the circuit board 86. As used herein and in the claims, the terms "housing" and "support ring" are meant to refer to structures used for support of articles such as the transmitter board 86 discussed hereinafter. As used herein and in the claims, the term "axially" and variants thereof is defined as referring to a direction along the longitudinal axis of the arrow shaft 32, and the term "radially" and variants thereof is defined as referring to a direction normal to the longitudinal axis of the arrow shaft 32. For example, the radially outer surface of the bushing 62 may have a diameter of about 0.468 inch, and the radially inner surface of the housing 64 may have a diameter of about 0.471 inch in order to leave just enough slack for the housing 64 to slide easily over the bushing 62. The housing is received on the bushing to abut the shoulder 76 to restrain it from movement forwardly relative to the arrow 30, and the elastomeric ring 82, which is sized, as illustrated in FIG. 7, so that its radially outer portion protrudes from the groove 80, is inserted in the groove 80 to restrain the housing from movement rearwardly relative to the arrow 30 during normal flight of the arrow 30 through the air.

It is important, in order to be able to track a wounded deer by receiving signals from the transmitter (described hereinafter) on the transmitter board 86, that the transmitter and the housing 64 to which it is attached become embedded in the deer rather than perhaps passing through the deer with the arrow. In order to do so, in accordance with the present invention, the elastomeric ring 82 is sized and otherwise adapted to be removed from the groove 80 under the greatly increased force of the housing 64 acting there against during impact of the arrow 30 with a deer. For example, the elastomeric ring 82 may be composed of Buwa-N or other suitable material having a modulus of elasticity of about Durometer 70A (preferably between about 65 and 75) and be sized to extend a distance, illustrated at 90 in FIG. 7, of about ½ inch (preferably between about 0.40 and 0.52 inch) from the bottom of the groove 80, which may have a depth, for example, of about half that distance 90. Thus, about half of the elastomeric ring 82 may desirably extend above the groove 80 to restrain the housing 64 during normal arrow flight. An elastomeric ring 82 which Applicants consider suitable is one manufactured by Parker-Hanifin Corp. of Salt Lake City, Utah and identified by number AS568A-012. The elastomeric ring 82 is thus sized and adapted to become removed from the groove 80 under the force of impact of the arrow 30 with a deer with the result that the housing slides relative to the arrow 30 rearwardly along and off the bushing 62 and becomes free of the arrow and free to become embedded in the deer, as described hereinafter with reference to FIGS. 11 to 13.

The housing or support ring 64 is composed of, for example, Delrin plastic material (acepal homopolymer), manufactured by E.I. duPont de Nemours and Company of Wilmington, Del., or other suitable material. In order to enhance the ease of sliding of the housing 64 over the bushing, the bushing 62 is composed of, for example, a different plastic material, desirably one which is a little harder and impregnated with a lubricant. For example, the bushing may be composed of 6/6 Nylatron plastic material, which is manufactured by AIN Plastics of Mount Vernon, N.Y., and which is impregnated with molybdenum disulfide lubricant.

The housing 64 is generally doughnut-shaped, having a radially outer surface 87 the rear portion 89 of which is cylindrical and the forward portion 91 of which is conically-shaped, i.e., it flares radially inwardly at a small angle of, for example, about 1 degree, the flared surface being provided to minimize weight added to the arrow 30. Cut-outs 93, for example, three, extend axially through the thickness of the housing 64 to also minimize weight added to the arrow 30. A cut-out 95 is also provided in the circuit board 86 to minimize weight added to the arrow 30.

Spaced circumferentially about the housing 64 are a plurality of, for example, three axially extending through bores 92 each having a forward counterbore 94 defining a forward facing shoulder 96. Elongate casings 98*a*, 98*b*, and 98*c* are received in the counterbores 94 to rest on the shoulders 96 respectively and extend forwardly beyond the housing 64. The inner diameter of each casing 98 is substantially equal to the diameter of the bore 92. The casings 98 are attached to the housing 64 by threading or by other suitable means. The thickness of the housing 64 is selected to suitably hold the casings 98 in such a cantilever fashion sufficiently firmly. For example, the housing 64 may have a thickness of about 0.06 inch. This allows the thickness of the housing 64 to be minimized to again minimize weight added to the arrow 30. The diameter of the housing 64 as well as the circuit board 86 is, for example, about 1.4 inch but is preferably about 1 inch or less. The length of each of the casings 98 is, for example, about 0.85 inch, and the length of each of the point heads 104 is, for example, about 0.47 inch.

A battery 100 (sized to last, for example, about 1 or 2 days) is received snugly but loosely in each of two of the casings 98*a* and 98*b* and can extend into the respective bore 92. A similarly sized container 102 is received loosely in the third casing 98*c*. As desired, the container 102 may contain transmitter circuit components or have other purposes such as for carrying a spare battery or filler material for purposes which will be discussed hereinafter. The forward opening of each casing 98 is closed by a pointed head 104 having a rearward cylindrical portion 106 which slides into the forward end of the casing 98 with a close fit, i.e., the diameter of the cylindrical portion 106 may, for example, be about 0.160 inch, and the inner diameter of the casing 98 may, for example, be about 0.178 inch, thereby allowing some freedom of movement of the cylindrical portion 106 within the casing 98. The point head 104 also has a conical portion 105 terminating in a forward sharp point 107 for penetrating the deer or other wild animal for attachment of the housing 64 and transmitter 86 to the deer. The rear end of the conical portion 105 has an increased diameter over the cylindrical portion 106 to provide a shoulder 108 which rests on the end of the casing 98 for thereby locating the head position and preventing its movement further into the casing. The casings 98 and the point heads 104 are composed of stainless steel or other suitable material. The relatively small diameter of the casings 98 (the outer diameter may, for example, be about 0.188 inch) allows them to easily penetrate a deer or other animal, but the relatively large surface area of the housing 64 acts as a stop to further penetration so that the transmitter assembly 60 does not pass through the deer but becomes attached thereto so that the deer can be located.

Each battery 100 has an elongate negative terminal 109 which extends from the rear end thereof and is received in and electrically connected to electrically conductive contact or pin 110 which is received in an aperture 112 in the circuit board in contact electrically with an electrically conductive grounded metal pad which is printed onto the circuit board 86. The cylindrical end wall 111 of the battery 100 constitutes a positive terminal which makes electrical contact with another electrically conductive metal pad which is printed onto the circuit board 86 by means of a small conductive spring 114 (having a diameter equal substantially to that of the battery 100) which is received in each bore 92 between the respective terminal 111 of the battery 100 and the respective metal pad on the circuit board 86 (and a similar spring 114 is received in the respective bore 92 between the container and the circuit board 86) to bias movement of the respective battery 100 or container 102 as well as the point head 104 in a forward direction as well as to provide electrical connections of the batteries 100 with the circuit 115. The metal pads on the circuit board for contact with the negative and positive terminals 109 and 111 respectively of the respective battery 100 are suitably formed and electrically insulated from each other in accordance with conventional circuit board design and manufacturing principles. The connection of the batteries 100 to the transmitter circuit, illustrated at 115 in FIG. 23, is similar to that shown for connection of batteries 244 in the transmitter circuit 222 in FIG. 22, and such a connection is described and shown in greater detail hereinafter with reference to FIG. 38, with pins 110 being similar to and serving a similar function to pins 254 in FIGS. 22 and 38 and with springs 114 being similar to and serving a similar function to springs 249 in FIGS. 22 and 38. The transmitter circuit 115, which includes four or other suitable number of capacitors 117 for boosting voltage of batteries 100 for intermittent transmissions, is described hereinafter with reference to FIG. 23.

A barb or elongate member 116 is inserted in an opening 118 in each casing 98 and into a blind opening 120 in the respective point head 104. The force of the spring 89 pinches the barb 116 to hold it tightly in the openings 118 and 120 to thereby securely hold the point head 104 to the casing 98. The barbs 116 extend at an angle, illustrated at 122, backwardly from the casing 98 of, for example, about 40 degrees and have sharp points 124 to act as fish hooks to keep the transmitter assembly 60 attached securely to the deer or other animal.

Figure 11:
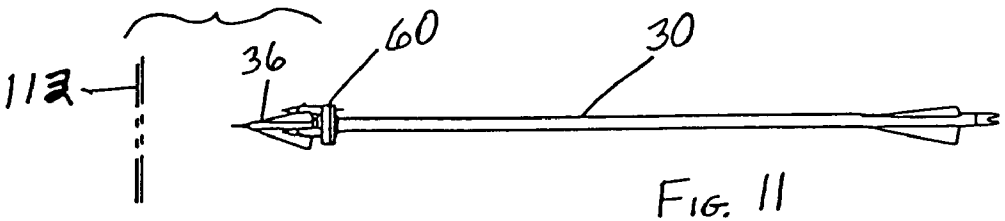
FIG. 11 is a side view illustrating the arrow with the transmitter assembly attached in flight.
Figure 12:
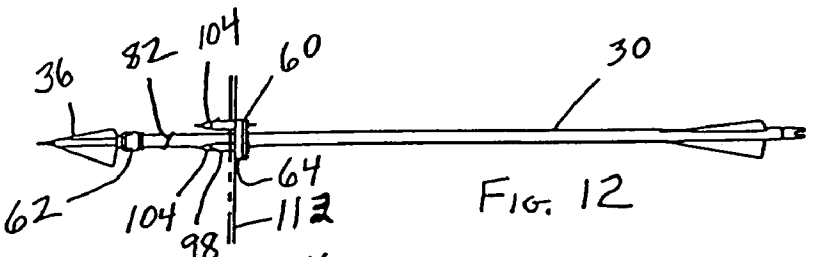
FIG. 12 is a view similar to that of FIG. 11 illustrating the arrow striking an animal and the transmitter assembly separating from the arrow and becoming embedded in the animal.
Figure 13:
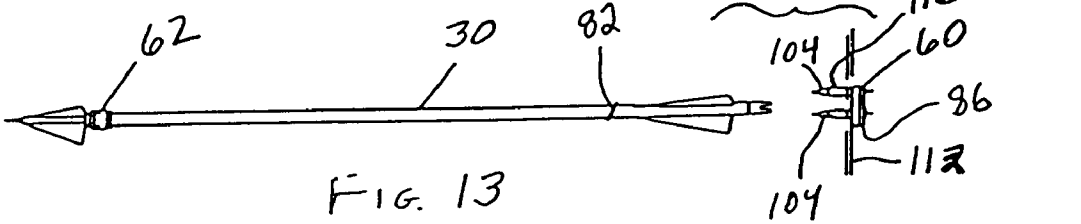
FIG. 13 is a view similar to that of FIG. 11 illustrating the arrow passing through the animal and leaving the transmitter assembly embedded in the animal.
Figure 14:
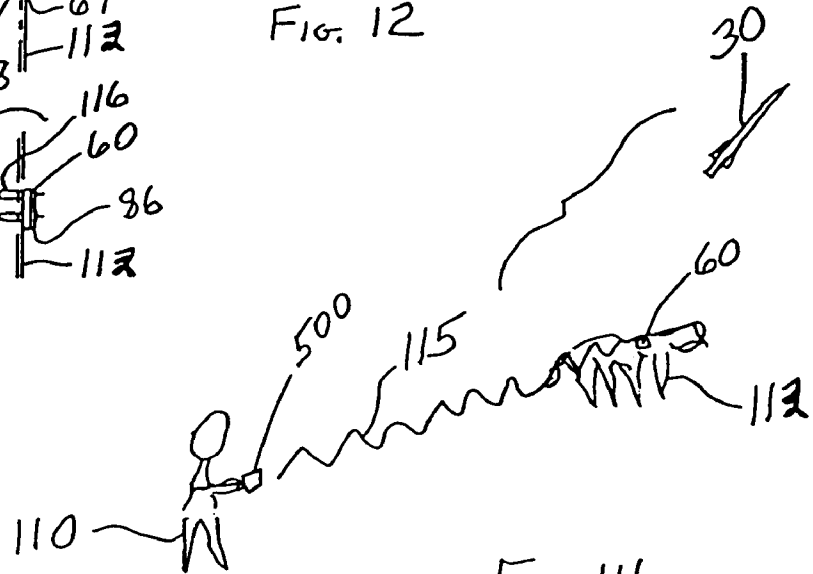
FIG. 14 is a schematic illustration of use of a receiver embodying the present invention in communication with the transmitter for tracking the animal.

Referring to FIGS. 11 to 14, there is illustrated in FIG. 11 the arrow 30 shot by a hunter 110 in flight toward a target, i.e., such as a deer 113, with the transmitter assembly 60 carrying the transmitter 86 held in place on the arrow by the o-ring 82 set in the groove 80. As seen in FIG. 12, the arrow 30 has pierced and is passing through the deer 113, and the force of impact with the deer has dislodged the o-ring 82 from the groove 80 so that the transmitter assembly 60 separates from the arrow 30. The release bushing 62 remains in place on the arrow 30. The point heads 104 on the transmitter assembly 60 pierce the deer 113 to the depth of the housing 64 which, due to its large surface area, acts as a stop to further penetration. Thus, the housing 64 and transmitter 86 become attached to the surface of the deer and are secured thereto by the point heads 104 and casings 98 embedded in the deer. The barbs 116, which are angled backwardly, as previously discussed, and have sharp points 124 on their ends, act as fish hooks to prevent the transmitter assembly 60 from falling out of the deer. As seen in FIG. 13, the arrow 30 continues to pass through the deer 113, as is typical, leaving the transmitter assembly 60 on the deer 113 to transmit signals, illustrated at 115. As seen in FIG. 14, these signals 114 are received by a hand-held portable indicator unit 500 carried by the hunter, thereby providing an indication to the hunter of the direction to the transmitter assembly 60 and thereby the deer or other prey animal after the deer has left the vicinity where it was shot so that the hunter can go to that location and retrieve the deer 113.

It is important that the weight and size of the transmitter assembly 60 be minimized and that its weight be distributed in a balanced manner about the arrow 30 in order that the transmitter assembly 60 have minimal impact on arrow trajectory. Thus, as discussed in some instances heretofore, components where possible are made of light weight material such as plastics, and weight is removed such as by lightening holes 93 and 95 as much as possible from components without compromising integrity. Weight at a distance from the arrow shaft has a greater impact on arrow trajectory than weight closer to the shaft. Thus, the overall size radially is minimized, and the removal of weight by tapering housing portion 91 desirably reduces the impact on arrow trajectory more so than if the same weight were removed closer to the shaft. The transmitter weight is also minimized to keep the overall weight of the transmitter assembly 60 down. The weight of broadheads typically range from about 75 to 125 grams, the greater the weight the less the arrow speed but the greater the broadhead penetration. The overall weight of the transmitter assembly 60 and bushing 62 as described herein and as assembled by Applicants is less than 100 grams, and the overall weight of such an assembly is preferably less than 50 grams. It is considered that a combined weight of, for example, about 175 grams for the broadhead 36, the transmitter assembly 60, and the bushing 62 is suitable as long as symmetry is maintained, as discussed hereinafter.

It has been found that a transmitter assembly with two point heads 104 and two casings 98 may not engage the deer properly when the target is hit with the point heads and casings in vertical alignment. It is thus preferred that the transmitter assembly 60 have three point heads 104 and three casings 98 as described herein since this eliminates the above engagement problem and since this matches the three blades of a typical broadhead and thereby provides symmetry which minimizes balance problems. In order to maintain balance, the weight of the container 102 and its contents preferably equals the weight of one of the batteries 100.

Figure 6:
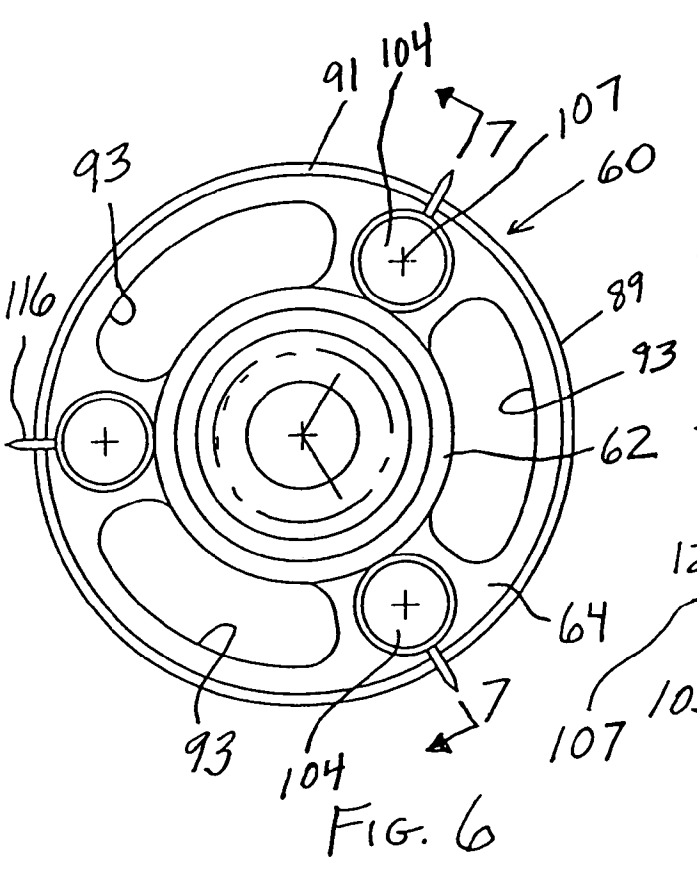
FIG. 6 is a plan view of the transmitter assembly.
Figure 8:
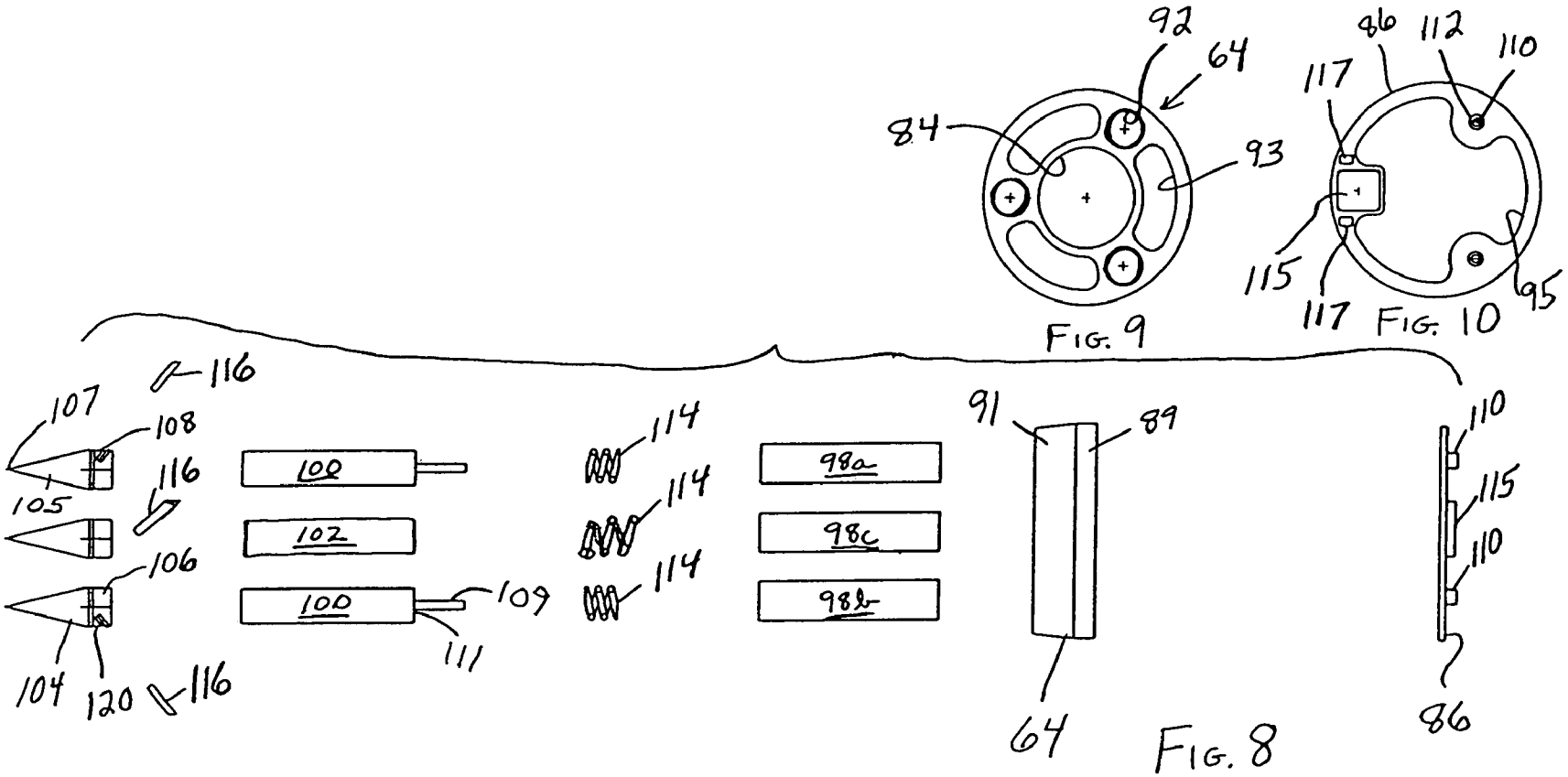
FIG. 8 is an exploded view of the transmitter assembly, a bushing therefor not shown in this view.

As described above, the components of the transmitter assembly 60 and the bushing 62 are distributed about the arrow shaft so as to maintain symmetry and balance, as best seen in FIG. 6. In order to achieve optimum balance, the transmitter assembly 60 is preferably dynamically balanced, i.e., spin balanced, similarly as done for automotive tires.

Figure 18:
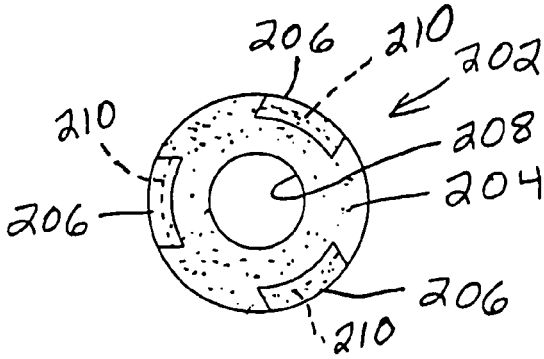
FIG. 18 is an end view of the release bushing therefor, taken along lines 18-18 in FIG. 16.
Figure 19:
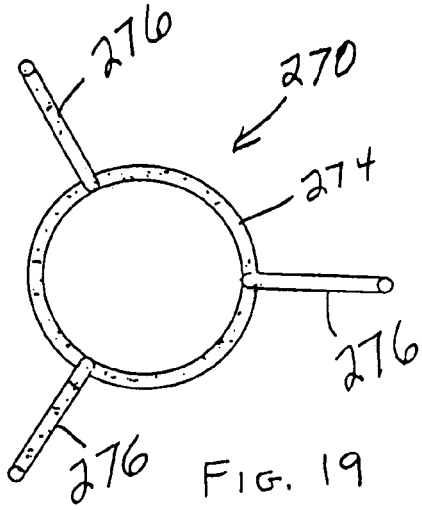
FIG. 19 is a view of the hook assembly therefor, taken along lines 19-19 in FIG. 16.

Referring to FIGS. 15 to 21, there is shown generally at 200 a transmitter assembly in accordance with an alternative embodiment of the present invention. The transmitter assembly 200 is releasably attached to arrow 30 by means of a bushing 202. The release bushing 202, which may be composed of 6/6 Nylatron plastic or polymeric material of the Polymer Corporation of Reading, Pa. or of other suitable material, has a flat circular (washer shaped) portion 204 having a central aperture, illustrated at 208, and from the outer circumferential edge of which extend rearwardly three circumferentially evenly spaced elongate generally flat prongs 206 which are arcuate, as seen in FIG. 18, to conform with the circular curvature of the portion 204. The arrow shank portion 44 is received in the washer-shaped portion aperture 208 as well as in a central aperture, illustrated at 290, of a protective cap 292 so that the washer-shaped portion 204 (as well as the cap 292, the aperture 290 of which is forward of the washer-shaped portion 204) is secured between the collar 48 and the arrow shaft 32 when the arrow shaft is attached to the broadhead 36 as previously discussed. The prongs 206 extend rearwardly along and in generally surrounding relation to the arrow shaft 32. The prongs 206 have axially aligned grooves, illustrated at 210, in the outer surfaces 211 thereof adjacent the rear ends thereof for purposes which will be discussed hereinafter. For the purposes of this specification and the claims, the outer surfaces of the three prongs 206 are together defined as an outer surface of the bushing 202, and the three aligned grooves 210 are together defined as a groove. The washer-shaped portion may, for example, have a thickness of about 1/16 inch, a diameter of about 7/16 inch, a diameter of aperture 208 of about 3/16 inch, and an overall length of about 1¼ inch. Each of the prongs 206 may, for example, have a thickness of about 1/16 inch, with the depth of each of the grooves 210 being about 1/32 inch.

Figure 20:
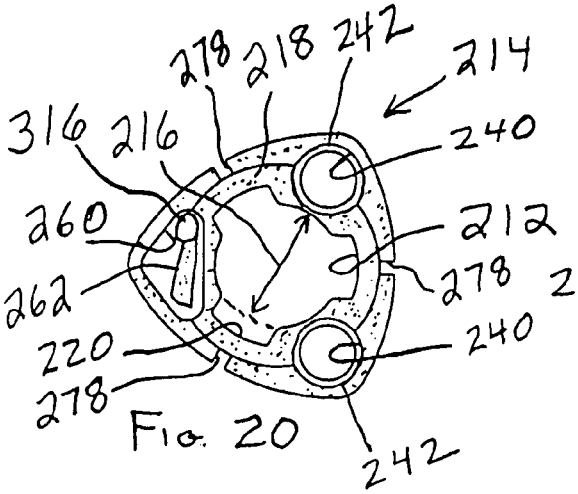
FIG. 20 is an end view of the transmitter housing therefor, taken along lines 20-20 in FIG. 16.
Figure 21:
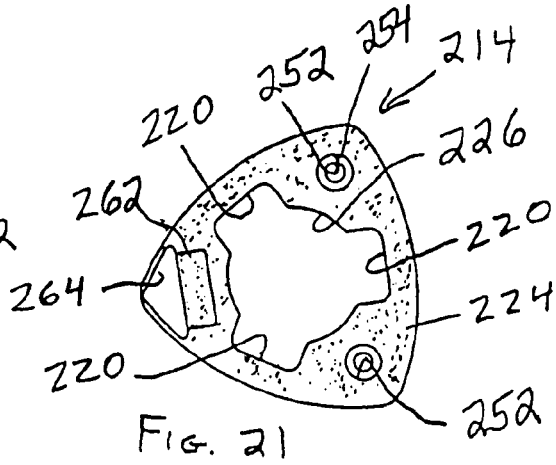
FIG. 21 is the rear side plan view of the antenna portion of the transmitter assembly therefor, taken along lines 21-21 in FIG. 16.

The prongs 206 are received in a bore, illustrated at 212, which extends entirely through a transmitter housing 214. The housing 214 is composed of Delrin plastic material, a product provided by E.I. duPont de Nemours and Company of Wilmington, Del., or other suitable material. As seen in FIGS. 20 and 21, the housing 214 is generally triangular-shaped (with arcuate sides and rounded corners) along its length. A portion 218 protrudes from the forward end a distance of, for example, about 1/16 inch, and is circular with generally truncated corners corresponding to the rounded triangular corners of the housing 214, for purposes which will be discussed hereinafter. The bore 212 is generally circular with a diameter, illustrated at 216 in FIG. 20, of, for example, about 5/16 inch, which is smaller than the diameter of the washer-shaped portion 204 so as to act as a stop for the washer-shaped portion 204 which accordingly abuts the forward end of the housing 214 to suitably position the bushing 202. The bore 212 has three circumferentially evenly spaced cut-outs, illustrated at 220, in its edge which are suitably shaped to receive the respective prongs 206. A transmitter/antenna assembly/circuitry 222 has a generally flat antenna portion 224 (a thickness of, for example, about 1/32 inch) which has a central bore, illustrated at 226, which is similarly shaped as bore 212 so as to be aligned therewith, the flat portion being suitably secured to the rear end of the housing 214 similarly as circuit board 86 is attached. The antenna portion 224 also serves as a circuit board. At 228 is a slightly undercut portion (depth of, for example, about 1/64 inch) in the radially outer surface of the housing 214 for a distance of, for example, about 1/8 inch from the rear end thereof. The prongs extend entirely through the bore 212 and through bore 226 so that the grooves 210 are outside but closely adjacent the rear side of the flat antenna portion 224.

In order to releasably secure the housing 214 to the release bushing 202, an elastomeric o-ring 230 is received in the aligned grooves 210 of the prongs 206. The position radially of the grooves 210 is such that the o-ring 230 bears against the rear side of the antenna portion 224 whereby, in accordance with the present invention, the bushing 202 is secured within the housing 214 to hold the housing on the arrow 30 during flight thereof, but the strength of the o-ring 230 is such as to be removed from the grooves 210 to allow the housing 214 to detach from the bushing 202 and the arrow under the force of impact of the housing 214 with a deer 113 or the like. Thus, the o-ring 230 may have a diameter, illustrated at 232 of, for example, about 1/16 inch (or about twice the depth of the grooves 210) so as to protrude from the grooves 210. For example, the elastomeric ring 230 may be composed of a similar material as elastomeric ring 82 is composed. The elastomeric ring 230 is thus sized and adapted to become removed from the grooves 210 under the force of impact of the arrow 30 with a deer with the result that the housing 214 slides, relative to the arrow 30, rearwardly along and off the bushing 202 and becomes free of the arrow and free to become embedded in the deer 113.

Two of the three apex portions of the triangular housing 214 have bores, illustrated at 240, extending therethrough in which are received snugly but loosely suitable cylindrical batteries or dry cells 244, for example, Panasonic BR435 (sized to last, for example, about an hour). The batteries 244 are held in place to the rear by the antenna portion 224 and forwardly thereof by suitable battery retainers or caps 248 (secured in counterbores illustrated at 246) or by other suitable means. The retainers 248 are shown to be generally washer-shaped.

Figure 22:
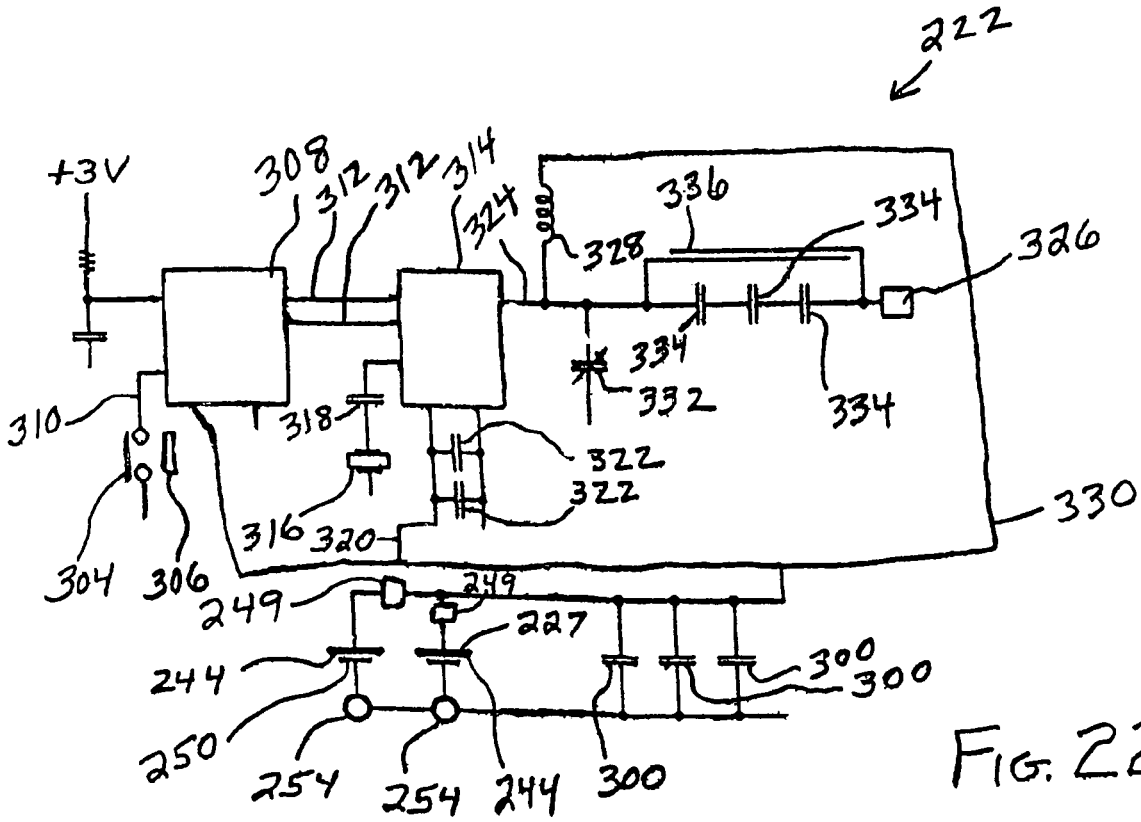
FIG. 22 is a schematic view of the transmitter circuit for the embodiment of FIGS. 15 to 21.
Figure 23:
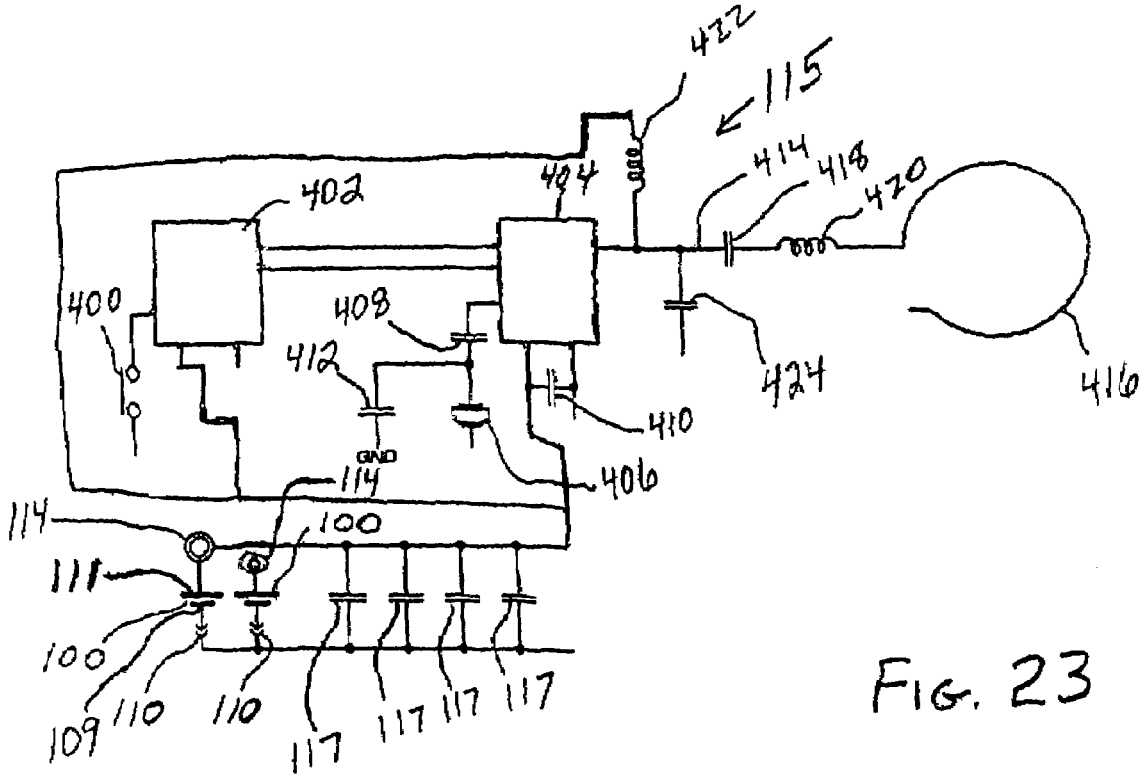
FIG. 23 is a schematic view of the transmitter circuit for the embodiment of FIGS. 1 to 13.
Figure 38:
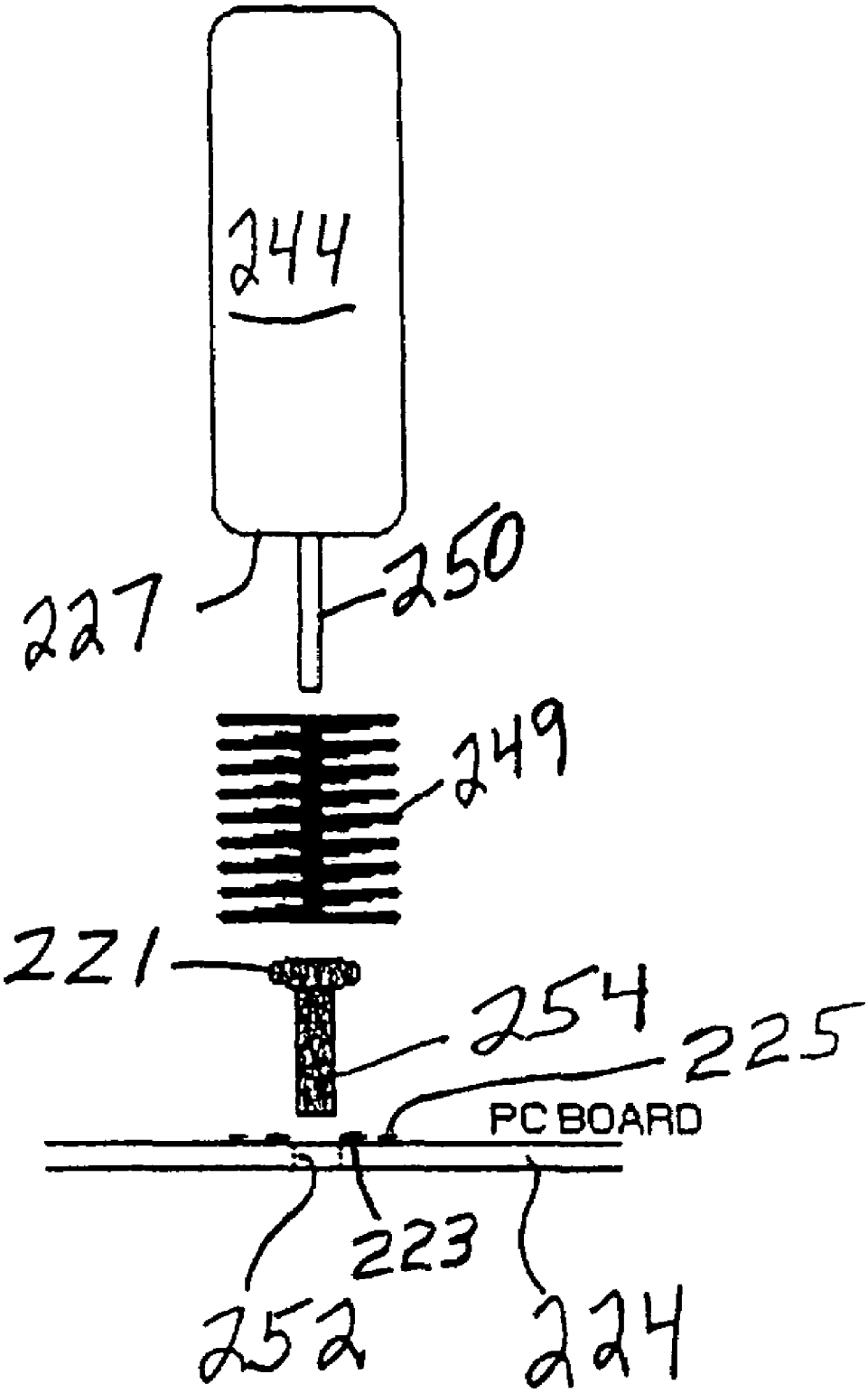
FIG. 38 is an exploded view illustrating the connections of the batteries of the circuit of FIG. 22 to the circuit board.

Referring to FIG. 38 as well as FIG. 22, the batteries 244 are connected in parallel with each other and with three or another suitable number of capacitors 300 (in parallel with each other) whose function is to store up power between transmissions for use during transmissions. Each battery 244 has an elongate negative terminal 250 which extends through but does not contact spring 249 and is received in an electrically conductive female pin 254 which in turn is received in an aperture, illustrated at 252, in and soldered (to secure it in place) to an electrically conductive grounded ring 223 printed on the circuit board 224, with the head 221 of the pin overlying and in electrical contact with the printed-on ring 223. Thus, the negative terminal 250 is electrically connected to the grounded ring 223. An outer concentric ring 225, insulated (electrically isolated) from inner ring 223, is also printed onto the circuit board. The two rings 223 and 225 are part of the circuit board copper (conductive) pattern and are thus formed in accordance with conventional circuit board design and manufacturing principles. The cylindrical end wall 227 of each battery 244 constitutes a positive terminal of the battery 244 and is therefore suitably insulated from the negative terminal 250. The small conductive spring 249 electrically connects the positive terminal 227 to the outer ring 225. Battery 244 is thus suitably shaped for the intended purpose while providing suitable means for both positive and negative terminals connecting suitably to the circuit board while offering long life with small size.

The other of the three apex portions of the triangular housing 214 has a bore, illustrated at 260, extending therethrough in which is received the transmitter circuit board 262, which is welded or otherwise suitably attached to the antenna board 224, the opening 264 in the antenna board 224 corresponding to (is in alignment with) the bore 260. Similarly as described for the embodiment of FIGS. 1 to 13, the components of the assembly 200 are desirably distributed about the arrow shaft so as to maintain symmetry and balance. This would include providing components of equal weight in each of the three apex portions, i.e., the transmitter circuit board 262 in one apex portion having substantially the same weight as that of the battery, retainer, and casing in each of the other apex portions. As previously discussed, in order to achieve optimum balance, the assembly 200 is preferably dynamically balanced.

The truncated portions of the circular portion 218 allow access to the three apex portion bores 240 and 260. Although such access may not be needed to the bore 260, the truncation about bore 260 at least provides symmetry.

Illustrated at 270 is a hook assembly providing three hooks 272 for penetrating the deer 113 or other animal for attaching the housing 214 thereto as the arrow, with the bushing 202 released from the housing 214, passes further into or through the animal. The hook assembly, which is composed of stainless steel or other suitable material, comprises a circular ring 274 from which three equally circumferentially spaced elongate shanks 276 extend axially of the ring 274. The ring 274 is received about the circular forward housing portion 218 thereby protectively covering the three apex portion bores 240 and 260. The shanks 276 extend rearwardly from the ring 274 and are received (press-fitted) in slots, illustrated at 278, which are centrally located in each of the three walls of the generally triangular-shaped housing 214 over the lengths thereof. The slots 278 may, for example, have a depth of about 1/16 inch and a width of about 1/32 inch. The shank end portions 280 (which terminate in the hooks 272) are curved so as to extend radially from the slots 278 and then forwardly thereby orienting the flesh-piercing hooks 272 to face forwardly for penetrating the deer as it is shot by the arrow.

In addition to the aperture 290, the protective cap 292, which may be composed of Delrin or other suitable material, has first, second, and third counterbores 294, 296, and 298 respectively, each being of a greater diameter than the previous. The diameter of the aperture 290 may be the same as the diameter of the washer-shaped portion 204 for receiving the arrow shank portion 44. The first counterbore 294 is sized to snugly receive the washer-shaped portion 204. The second and third counterbores 296 and 298 are provided to nest the transmitter housing 214 and the hook assembly 270 respectively.

The provision of the hook assembly 270 advantageously brings the mass closer to the center so that it has a lesser effect on arrow trajectory. The transmitter assembly 200 provides a narrower body which advantageously allows less resistance to penetration, less air resistance, less unbalanced effect due to torque, is desirably less noticeable (appearance-wise), and may weigh less (for example, the hook assembly 270 may weigh less than 6 grams vs. 45 grams for the point heads 104).

Referring to FIG. 22, the circuit 222 is activated by a suitable switch, for example, a magnetic reed switch 304 operable by a hand-carried magnet, illustrated at 306, which is briefly held near the switch 304 when the arrow is loaded for a shot. The transmitter is therefore operating prior to the shot so that proper operation of the transmitter can be confirmed prior to the shot. The switch 304 is desirably fully enclosed in a glass envelope (not shown) to eliminate contamination and corrosion and thus yield increased reliability. Other types of switches may be used, for example, an inertial switch.

The switch 304 is connected via line 310 to a suitable microcomputer 308 which serves to detect closures of the switch 304 and which also serves to extend the battery life by "pulsing" the transmitter (when energized) at a rate of, for example, about 5 percent (extending battery life by a factor of 20 from, for example, 2.4 to 48 hours of battery life). This allows the batteries 244 to be much smaller (miniature) than would otherwise be practical, given the desired maximum range and life span of the transmitter. Thus, each of the miniature batteries 244 may, for example, have a voltage of about 3 volts and a size of about 0.16 inch diameter and about 1 inch long. The microcomputer 308 desirably is also equipped, using principles commonly known to those of ordinary skill in the art to which this invention pertains, to detect low battery conditions and shut down the transmitter to prevent harmful interference caused by an under-powered transmitter chip (hereinafter described) and to monitor battery condition and remaining life span and report (by telemetry) this information to the user so that an arrow is not selected and employed which has weak batteries. These functions of the microcomputer 308 are discussed in more detail hereinafter with reference to FIG. 35. The microcomputer 308 may, for example, be one sold by Digikey Corp. of Thief River Falls, Minn. and identified by part number 12F675-USN-ND.

The microcomputer 308 is electrically connected via lines 312 to a suitable integrated circuit UHF transmitter chip 314. The frequency of the chip 314 (radio frequency) is set by use of a quartz crystal 316 at, for example, 950 Mhz, and capacitor 318 in series therewith stabilizes the crystal 316 to the desired frequency. If needed, a variable capacitor may be provided in parallel with capacitor 318 to compensate for variances in frequency due to tolerances of the crystal 316. Power is supplied to the chip 314 via line 320, and two (or other suitable quantity) capacitors 322 in parallel with each other and between power line 320 and ground are provided to eliminate RF (radio frequency) interference to the microcomputer 308. The transmitter chip 314 may, for example, be one sold by Atmel Corp. of San Jose, Calif. and identified by part number T5750.

A signal at the desired frequency is transmitted from chip 314 along line 324 to antenna 326 which is an integrated loop antenna, which comprises a closed loop of metal printed directly onto the surface of transmitter board 222. The transmitter circuitry includes an X64 phase-locked-loop frequency synthesizer driving a low power antenna amplifier circuit (RF amplifier), which are integral with the transmitter chip 314 (not external thereto). An inductor 328 is electrically connected between the power line 330 and line 324 to provide DC power to the RF amplifier. Capacitor 332, which is electrically connected between line 324 and ground, and three (or other suitable number) capacitors 334, which are connected in series in line 324, are provided to achieve an "impedance match" between the antenna 326 and the transmitter chip 314 to increase the efficiency of the antenna 326, using principles commonly known to those of ordinary skill in the art to which this invention pertains.

If desired in order to allow careful tuning of the antenna, if necessary, after the transmitter is assembled, an adjustable capacitor may be provided in parallel with the capacitors 334. In the event that there is insufficient room on the circuit board for an adjustable capacitor, a trimcap, illustrated at 336, may, if needed, be provided in parallel with the capacitors 334. The trimcap 336, which is part of the copper pattern that is printed onto the circuit board, behaves electrically like a very small capacitor and serves the same purpose. The trimcap 336 comprises an oblong copper strip having a length of, for example, about 0.5 inch long, printed onto the circuit board and which can be "trimmed" with a sharp knife, such as, for example, an X-acto knife, to a length to achieve the desired precise tuning. Once the proper length is determined, subsequent transmitters can be provided with trimcaps which are trimmed to the same length.

Figure 25:
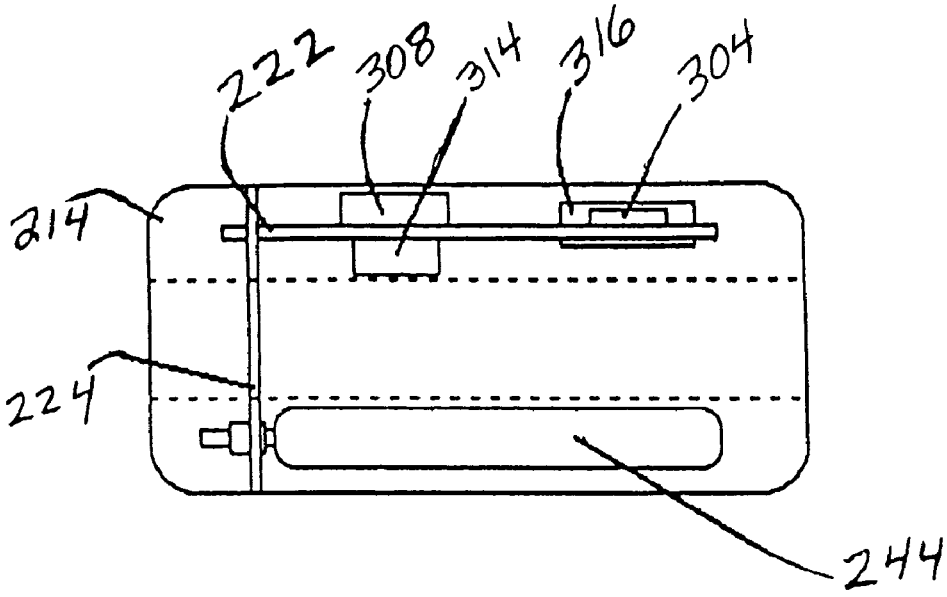
FIG. 25 is a schematic side view of the electrical components in the transmitter housing for the embodiment of FIGS. 15 to 21.

Referring to FIG. 25, the quartz crystal 316, magnetic switch 304, microcomputer integrated circuit 308, and transmitter integrated circuit 314 are all installed on printed circuit board 222. The second printed circuit board 224 provides the connections for the batteries 244 (as previously discussed) and also holds the antenna 326. The two boards 222 and 224 are permanently connected together such as by direct solder connections which join adjacent metal areas that are printed onto both boards 222 and 224.

Figure 35:
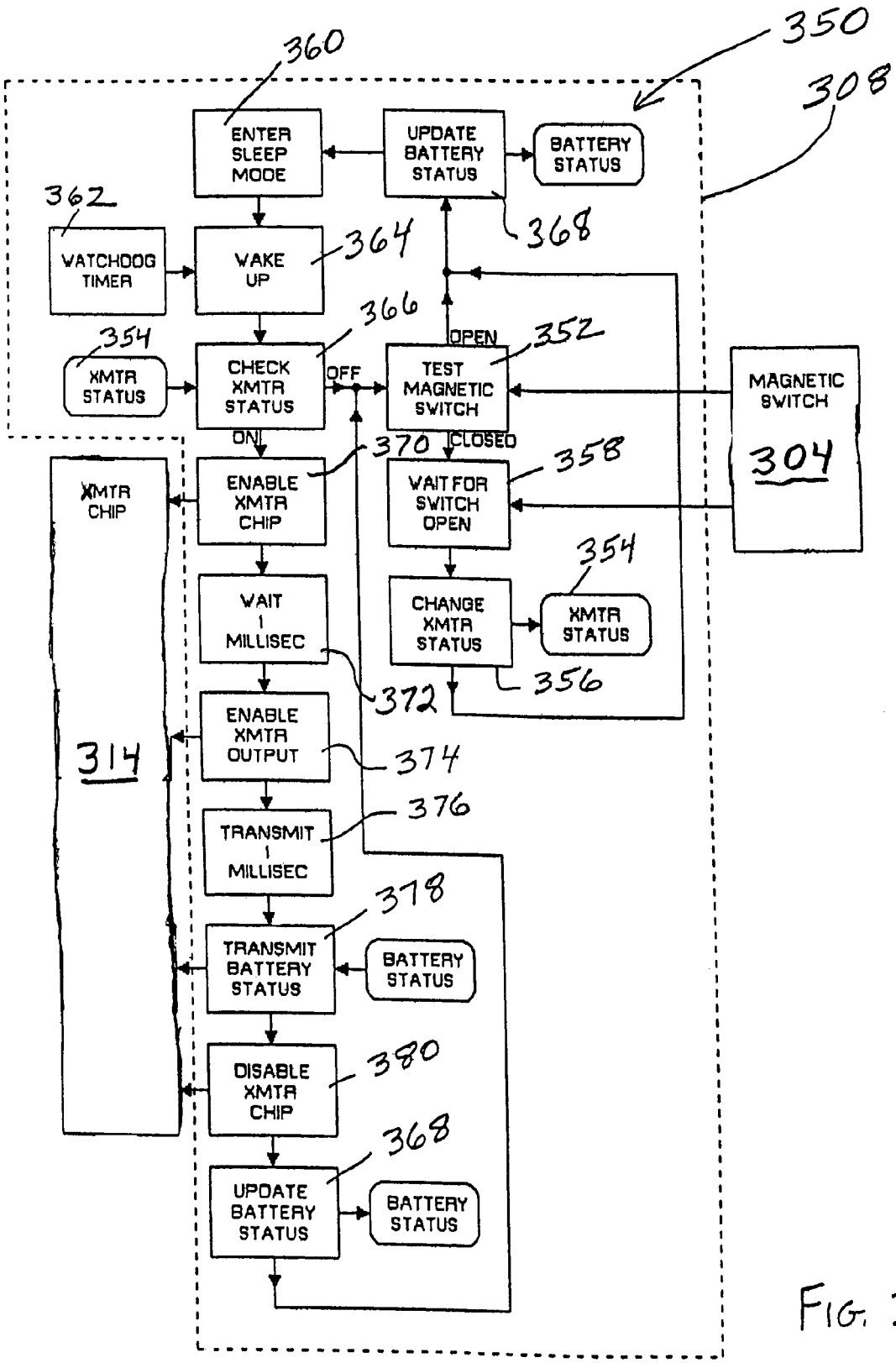
FIG. 35 is a software flow chart of the program for the transmitter microcomputer for the embodiment of FIGS. 15 to 21, the flow chart also being applicable to the embodiment of FIGS. 1 to 14.
Figure 36:
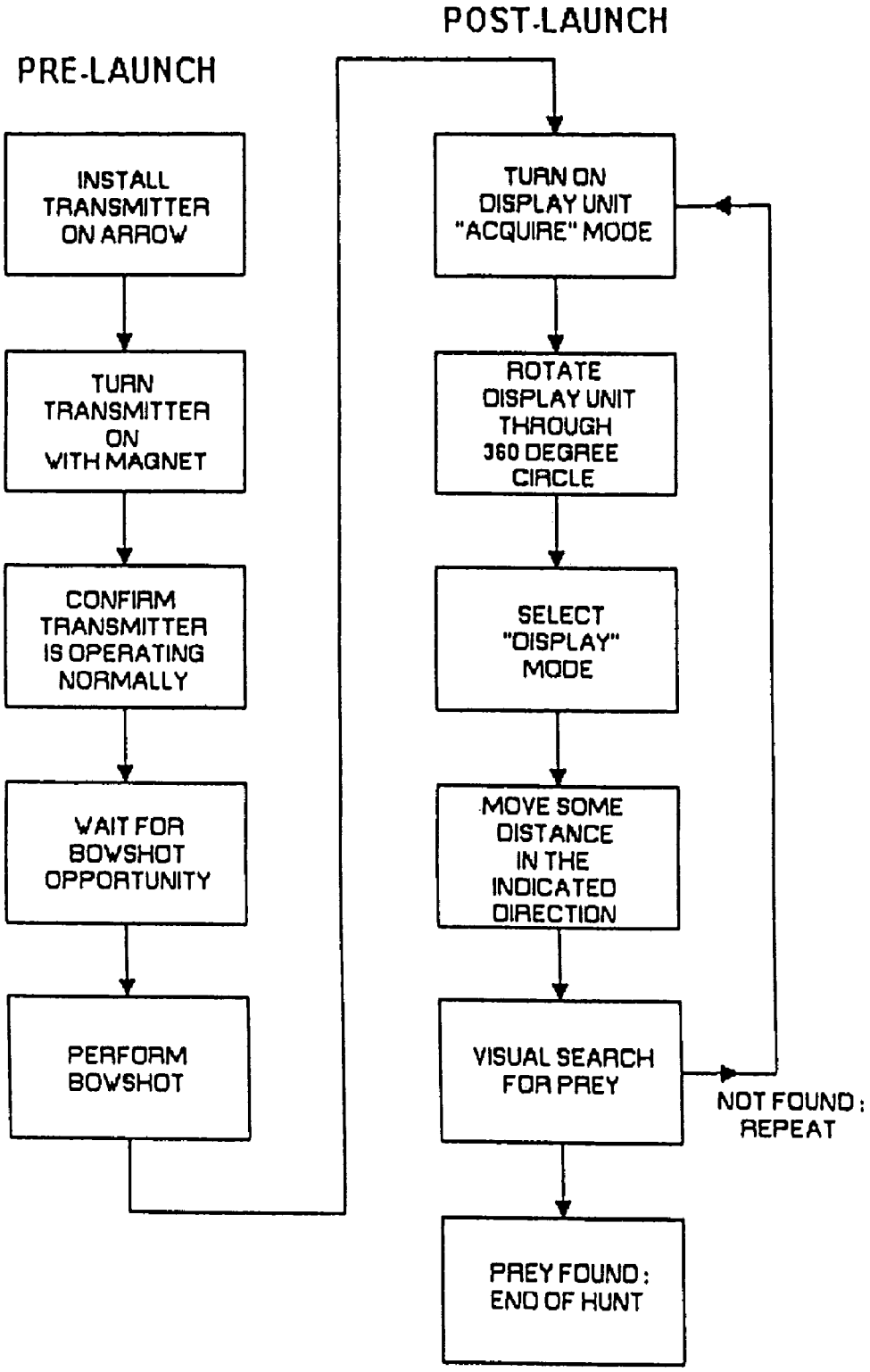
FIG. 36 is a block diagram (applicable to the transmitter embodiments of both FIGS. 1 to 14 and FIGS. 15 to 21) of the sequence of steps executed by the user for normal use of the transmitter/receiver system of the present invention.

Referring to FIG. 35, the microcomputer 308 has installed therein a program, illustrated generally at 350. The magnetic switch 304 is periodically examined, as illustrated at 352, to determine if the user wishes to switch the transmitter on or off. If the magnetic switch 304 is open, the battery status is updated, as indicated at 368, and sleep mode is entered, as indicated at 360. If the magnetic switch 304 is closed, opening thereof is awaited, as indicated at 358, after which there is a change of transmitter status 354, as indicated at 356. Each opening and closing of the magnetic switch 304 is treated as a single event (i.e., open+close=one event), and the reaction 356 of the microcomputer 308 to this event, a change in transmitter status 354, is determined by the condition of the transmitter prior to the event. If the transmitter was "on" prior to the event, the transmitter is switched "off" and remains "off" when the magnet 306 is removed. If the transmitter was "off" prior to the event, the transmitter is switched "on" and remains "on" when the magnet 306 is removed. The switch 304 is spring-loaded so that it normally is an "open circuit", and it only "closes" when a magnet 306 is held nearby. Removing the magnet 306 will restore the switch 304 to its "normally open" condition.

The microcomputer 308 is programmed to spend most of its time in a low-power operating mode called "sleep", as indicated at 360, during which the microcomputer 308 cannot execute any instructions, but it also advantageously draws very little current from the batteries 244 during this mode. An internal low-power timer, called "watchdog", indicated at 362, is used to interrupt the "sleep" mode, as indicated at 364, for example, approximately 50 times per second. Once "sleep" is interrupted, the execution of the program 350 proceeds. After the necessary tasks are completed, the microcomputer re-enters "sleep" mode, as indicated at 360, to conserve battery power.

Whenever the "sleep" mode is interrupted by the "watchdog" timer 362, the current status of the transmitter 314 is tested, as indicated at 366, to determine if the transmitter status is on or off. The current status of the transmitter is stored in the program 350 as a variable quantity, which can be changed by the program 350, as indicated at 356, as previously discussed. If the transmitter status is currently off, then no output pulse from the transmitter is required. The magnetic switch 304 is then tested, as indicated at 352 and as previously discussed. If the switch 304 is not closed (indicating that no magnet is nearby), the program 350, after updating the battery status, as indicated at 368, re-enters the "sleep" mode, as indicated at 360, to conserve battery power.

If the tested transmitter status is "on", the microcomputer integrated circuit enables the transmitter chip 314, as indicated at 370, for a period of, for example, 1 millisecond, but does not enable the transmitter output. This waiting period, indicated at 372, allows the quartz crystal 316 and the internal circuits of the transmitter chip 314 to "stabilize" prior to switching on the output of the transmitter integrated circuit. After the delay, the transmitter output is enabled, as indicated at 374, for a period of, for example, 1 millisecond, as indicated at 376. Following the 1 millisecond radio transmission, the microcomputer integrated circuit disables the transmitter integrated circuit 314, as indicated at 380, to conserve battery power, and the battery status is updated, as indicated at 368. If desired, the program 350 may include steps to transmit data about remaining battery life.

After the transmitter 314 is disabled, the program proceeds to the previously discussed testing of the magnetic switch 304, as indicated at 352. If the switch 304 is closed (indicating that a magnet 306 is near it), the program 350 waits until the switch 304 opens, as indicated at 358, then reverses the current status of the transmitter 314 (either on or off), as indicated at 356, then updates battery status and re-enters "sleep" mode, as indicated at 368 and 360 respectively. Thereafter, the "watchdog" timer 362 causes the program 350 to "wake up", as indicated at 364, and the cycle begins again.

The duration of the transmitter pulse in this embodiment is 1 millisecond. Only one pulse is generated during each program execution "loop". Execution of the program 350 is repeated in this embodiment approximately 50 times per second, because the internal "watchdog" timer 362 interrupts the "sleep" mode 50 times per second. This translates into a time interval (between "watchdog" interruptions) of approximately 20 milliseconds. The transmitter 314 is therefore turned on (when enabled) for only 5 percent of the time (1 millisecond divided by 20 milliseconds) to advantageously conserve and prolong battery life. Of course, programs in other embodiments may have different pulse durations and time intervals.

Battery power is applied to the microcomputer 308 and transmitter 314 at all times while the batteries 244 are installed. When the transmitter 314 is off, the transmitter integrated circuits are disabled by the microcomputer 308, and the microcomputer integrated circuit 308 is in the "sleep" mode for more than 99.9 percent of the time. The total load on the batteries 244 is therefore extremely low, so periodic battery replacement may not be required for several months. Whenever the transmitter 314 is turned on, battery load increases significantly, but the pulsed nature of the transmissions advantageously allows reliable operation for a period of 24 to 48 hours.

Referring to FIG. 23, there is shown a schematic of transmitter circuit 115 (loop) for the embodiment of FIGS. 1 to 13. Circuit 115 includes a magnetic switch 400, a microcomputer 402, a transmitter chip 404 with a quartz crystal 406 (for a radio frequency of 916 Mhz), stabilizing capacitor 408, and capacitor 410, all of which are similar to magnetic switch 304, microcomputer 308, transmitter chip 314 with quartz crystal 316, stabilizing capacitor 318, and pair of parallel capacitors 322 of the circuit 222 of FIG. 22. At 412 is a capacitor in parallel with the crystal 406 to fine-tune the crystal 406 to the desired frequency thereby compensating for crystal tolerance. The transmitter chip 404 outputs along line 414 to antenna 416, which is a grounded loop which may, for example, 1 inch in diameter and 0.05 inch in width. In series with the antenna 416 are a capacitor 418 and inductor 420, and an inductor 422 and capacitor 424 are each in parallel with the antenna 416 to achieve "impedance matching" to increase antenna efficiency in accordance with principles commonly known to those of ordinary skill in the art to which this invention pertains.

Figure 26:
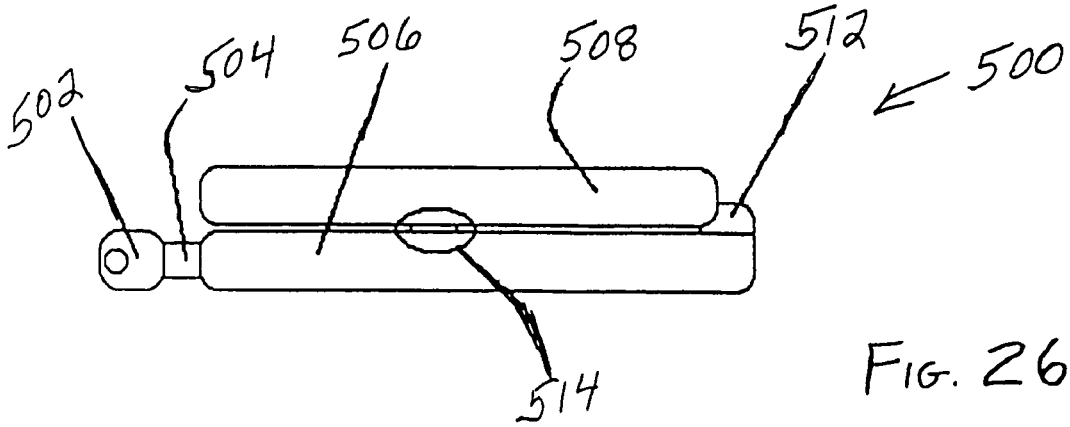
FIG. 26 is a side view of the receiver (display unit).
Figure 27:
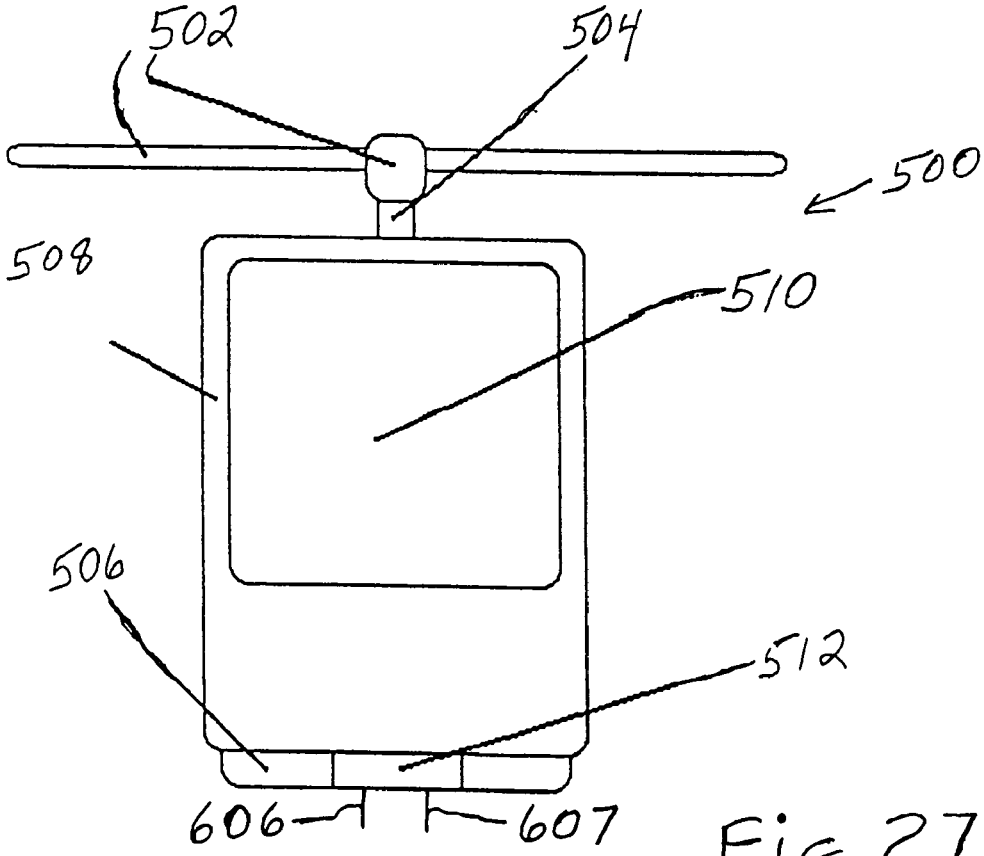
FIG. 27 is a top view of the receiver.
Figure 28:
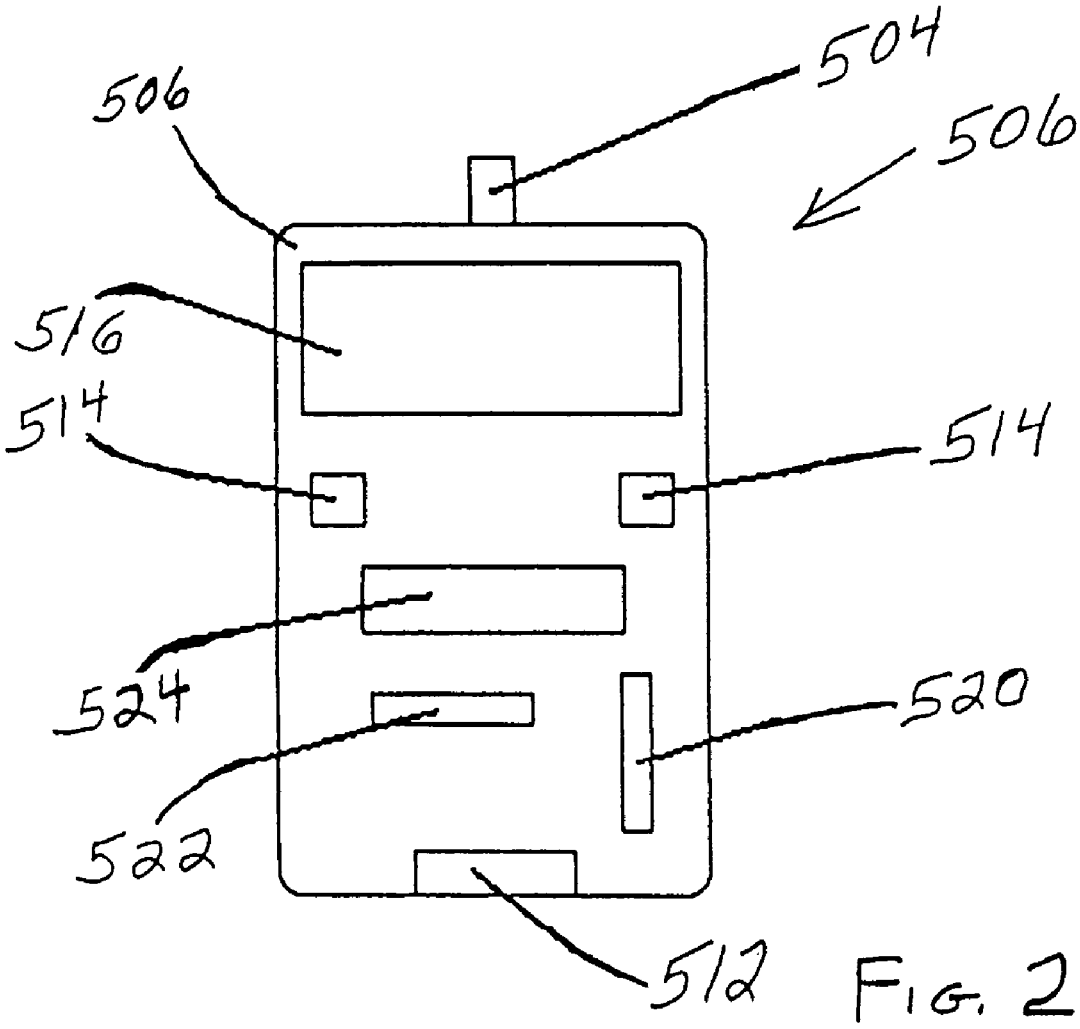
FIG. 28 is a schematic view of the internal elements of the direction finding unit for the receiver.
Figure 29:
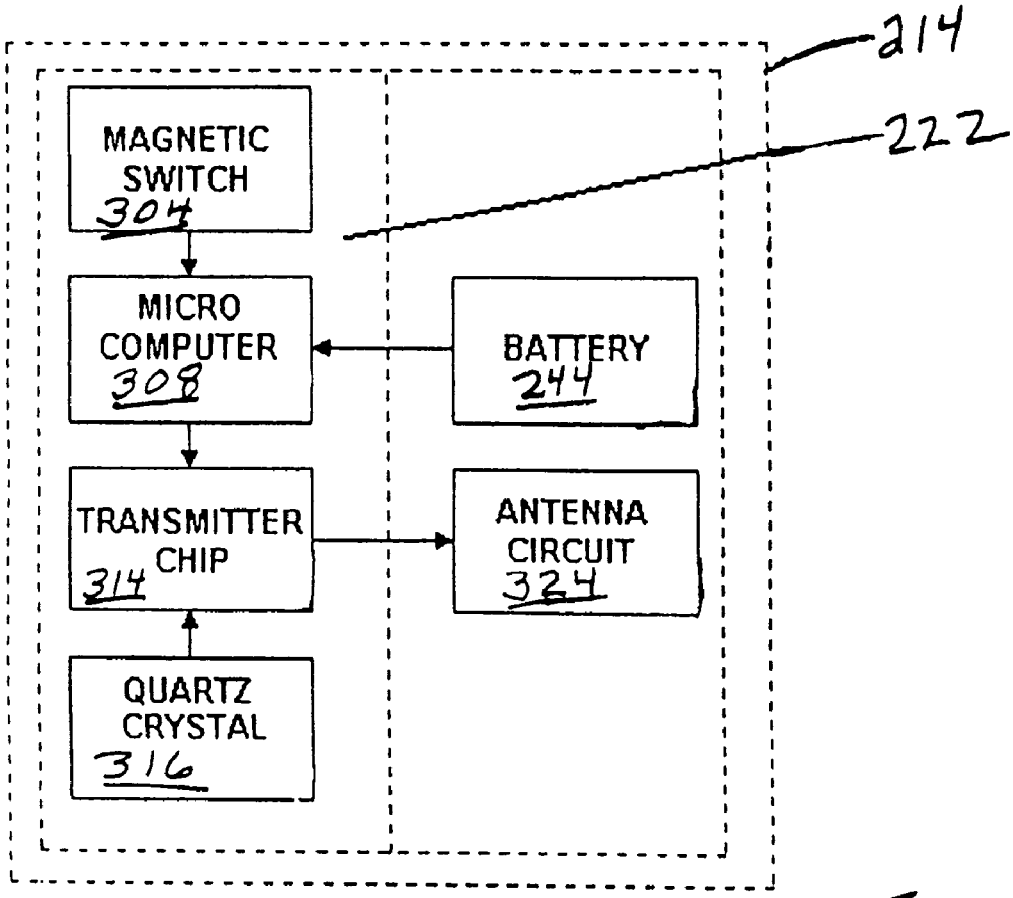
FIG. 29 is block diagram of the transmitter circuit for the embodiment of FIGS. 15 to 21, the block diagram also being applicable to the embodiment of FIGS. 1 to 14.

Referring to FIGS. 26 and 27, the portable indicator unit 500, which is usable for either of the transmitter embodiments described hereinbefore, includes a directional antenna 502, an antenna connector 504, a direction finding (DF) unit 506, a display computer 508 which includes an LCD display and touch-sensitive screen 510, a display connector 512, and a pair of latch mechanisms 514 (both shown in FIG. 28).

Referring to FIG. 28, the direction finder 506 includes a radio receiver 516, a microcomputer 524, a North-South compass sensor 520, and an East-West compass sensor 522.

Figure 30:
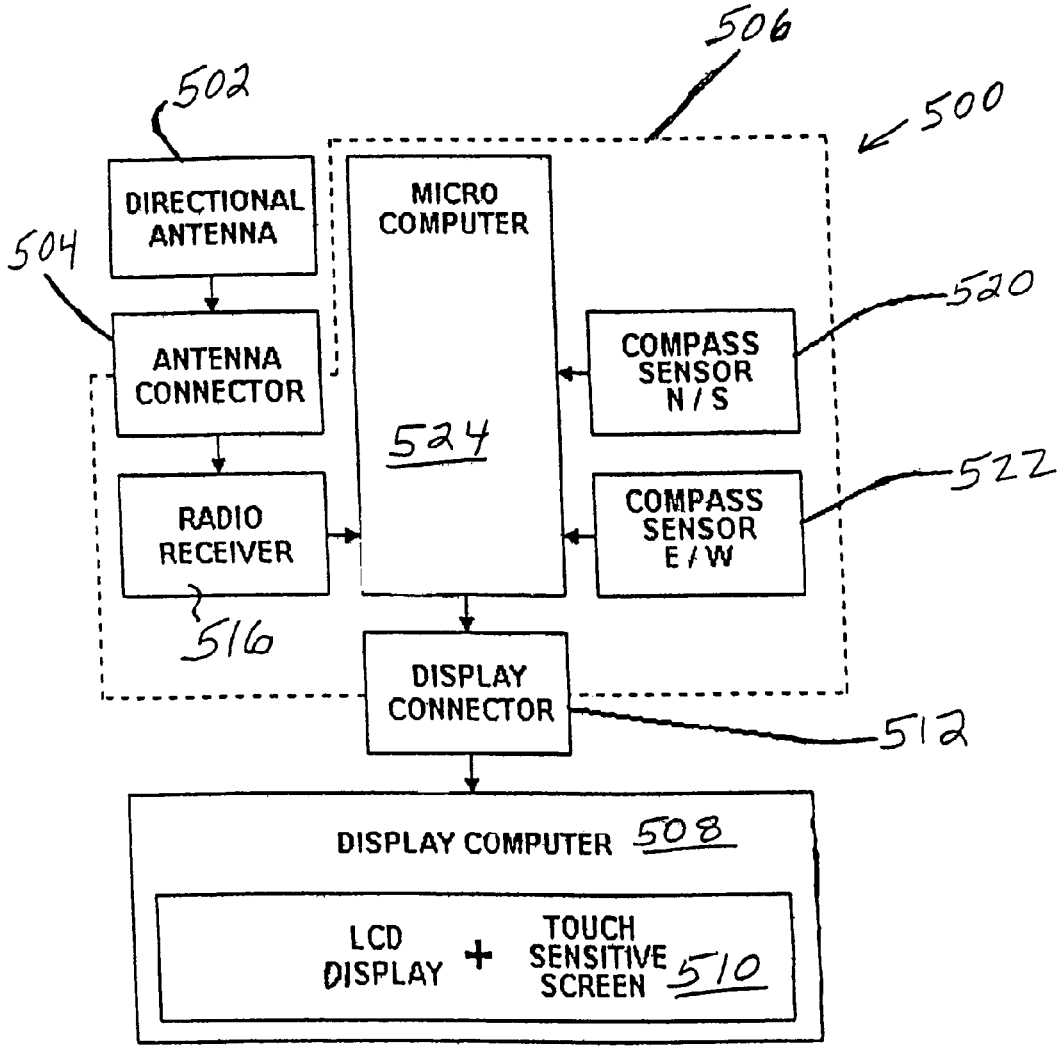
FIG. 30 is a block diagram of the receiver circuit.
Figure 31:
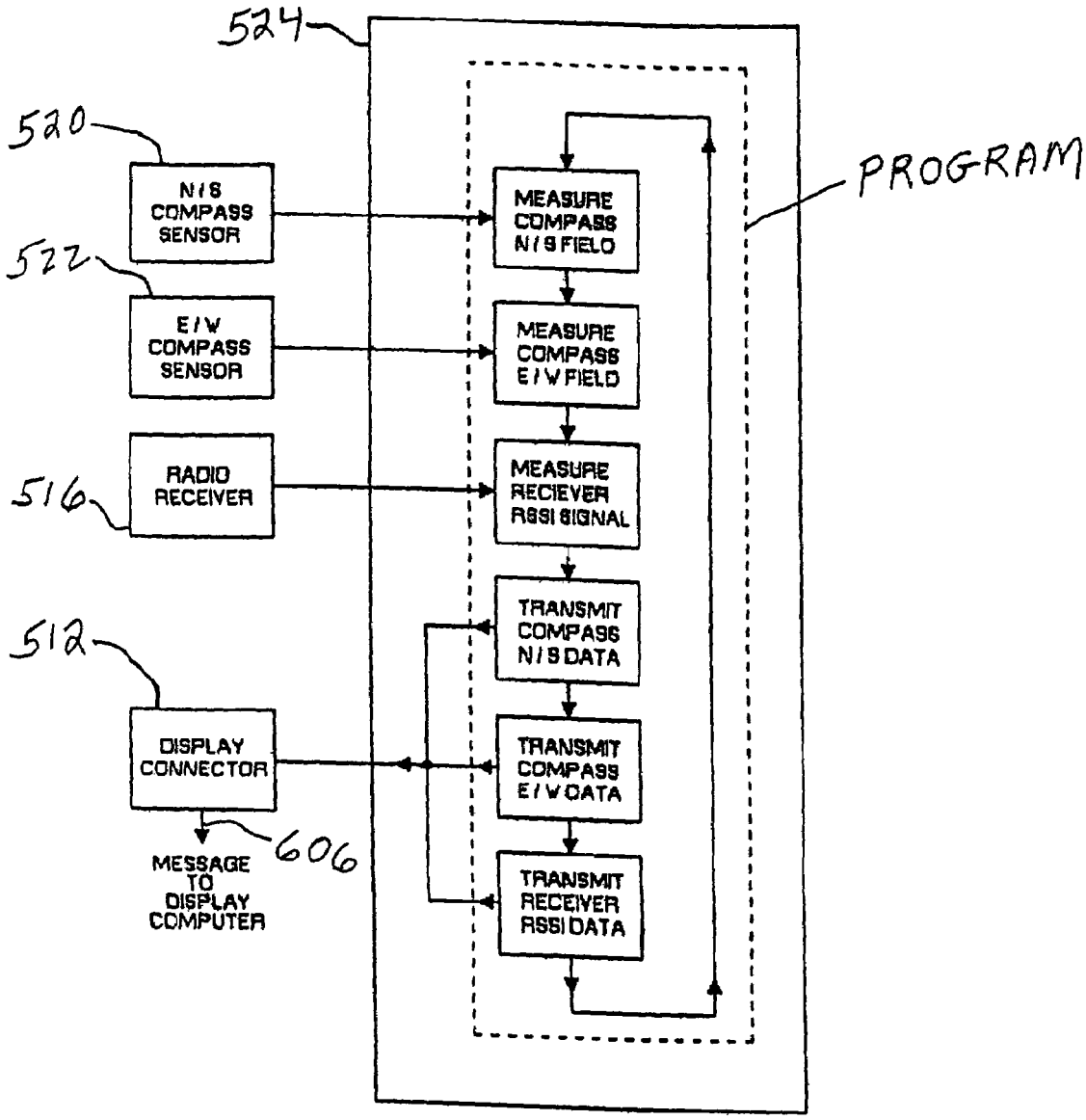
FIG. 31 is a software flow chart showing the sequence of tasks performed by the receiver microcomputer.

Referring to FIG. 30, the microcomputer chip 524 receives and processes signals from the radio receiver 516 and the compass sensors 520 and 522 and outputs signals (raw data) to the display computer 508 which are indicative of the direction to the transmitter 60 and thus the deer or other prey 113 and outputs such direction when operated in the manner hereinafter described.

Figure 24:
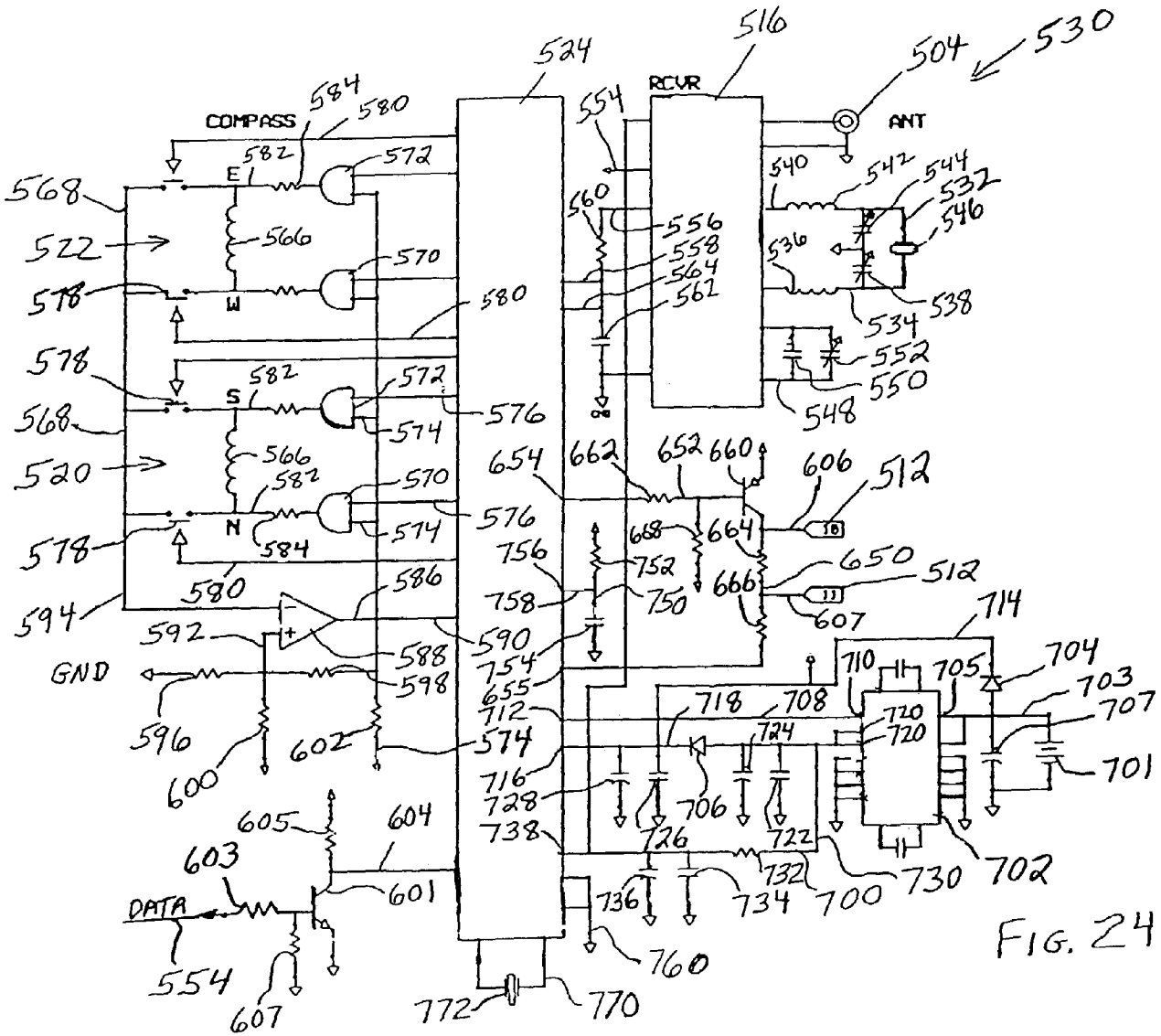
FIG. 24 is a schematic view of a receiver circuit for receiving transmissions from either of the transmitter circuits.

Referring to FIG. 24, there is illustrated generally at 530 the circuitry for the direction finding unit 506.

A suitable receiver 516 is, for example, one identified by number ATR5A-914, sold by Abacom Technologies of Etobicoke, Ontario, Canada, and which is modified in accordance with the following discussion. The receiver 516 includes a signal channel width circuit 532. In order that the transmitter batteries may be small and light, the circuitry 532 is provided to provide a very narrow channel width, for example, a channel width of 916.335 to 916.365 Mhz for a frequency of 916.35 Mhz. The circuit 532 has an intermediate frequency signal input line 534 to receiver 516, with an inductor 536 and a variable capacitor 538 and a mixer output signal line 540 also with an inductor 542 and a variable capacitor 544, and a filter in parallel therewith, the relationship between the capacitances of the variable capacitors 538 and 544 determining the channel width in accordance with principles commonly known to those of ordinary skill in the art to which this invention pertains.

The radio receiver 516 is tuned to the same frequency as the that of the transmitter 86 in the assembly 60 or transmitter 262 in the assembly 200. The tuning circuit 548 for the receiver 516 includes a capacitor 550 for selecting the channel and a variable capacitor 552 in parallel therewith for fine tuning, in accordance with principles commonly known to those of ordinary skill in the art to which this invention pertains.

The receiver 516 produces an output voltage that is proportional to the strength of the signal of the signal detected by the directional antenna 502, i.e., the signal received from the transmitter 86 or 262. This voltage is called RSSI or received signal strength indicator. Thus, a circuit 556 inputs a signal (analog voltage of, for example, 0.5 to 2.5 volts) which is representative of the received signal strength to the microcomputer 524 via line 558, which translates this signal into a numeric value that is stored in the microcomputer, using an analog-to-digital converter or ADC, in accordance with principles commonly known to those of ordinary skill in the art to which this invention pertains. The circuit 556 includes a stabilizing filter including a resistor 560 and a capacitor 562. The capacitor 562 charges to the maximum value level of the receiver RSSI signal level (ranging from 0.5 to 2.5 volts) during a pulse so that it is unnecessary to synchronize the microcomputer measurement of the signal strength with the transmitter pulse rate. Line 564 is provided to discharge the capacitor 562 to reset it for a new measurement of the received signal strength, each time a new RSSI measurement is performed.

The microcomputer 524 (grounded as illustrated at 760 and having a timing or "clock" circuit as illustrated at 770, having a quartz crystal 772, to provide a timing signal for running thereof) constantly performs measurements of the RSSI signal produced by the receiver 516 and also constantly performs measurements (vector components) of the Earth's magnetic field as observed by the two sensors 520 and 522. The resulting measurements are compiled into a message that is sent from microcomputer terminal or pin 654 via circuit 650 (FIG. 24), described in greater detail hereinafter, over line 606 to the display computer 508 at display connector 512 (FIG. 27). This message is constantly updated and re-transmitted to the display computer 508, for example, approximately 20 times per second. This message contains the RSSI measurement, the North-South compass sensor measurement, and the East-West compass sensor measurement. A suitable microcomputer 524 is, for example, one identified by number PIC16LC773-201/SO, sold by Digikey Corporation of Thief River Falls, Minn.

Each compass 520 and 522 has a magnetic sensor coil 566 whose electrical characteristics are influenced by the Earth's magnetic field, the coils 566 being oriented 90 degrees relative to each other so that one sensor is aligned to detect the North-South vector component of the Earth's magnetic field and the other sensor is aligned to detect the East-West vector component of the Earth's magnetic field, as observed by the direction finding unit 506. The maximum output of the coil 566 for the North-South compass occurs when facing North or South, and, similarly, the maximum output of the coil 566 for the East-West compass occurs when facing East or West. The compass circuit 568 includes a pair of gates 570 and 572 for the respective ends (such as North end and South end) of the respective coil 566. Each gate is normally on by virtue of voltage passing through power supply line 576 from microcomputer 524. Each gate is also connected to a line 576 from the microcomputer 524, which sends a signal through respective line 576 to turn the respective gate off. When a gate is turned off, the respective coil end is grounded by the output signal from the gate so that the directional component of the other end of the coil can be measured. Thus, when South gate 572 for North-South compass 520 is turned off, the opposite or North end of the North-South coil 566 is free to oscillate. The respective switch 578 for the oscillating coil end is also turned on by a corresponding signal through respective line 580 from microcomputer 524. This allows current to flow through a circuit including the corresponding line 582, corresponding resistor 584, the corresponding normally on gate (in our example, gate 570), corresponding line 574, line 586 which connects to the outlet pin of the differential amplifier 588, and line 594 which connects to one of two inlet pins of the differential amplifier 588. A circuit 592 containing parallel resistors 596, 598, and 600 connect to the other inlet pin of the differential amplifier 588. Resistors 596 and 600 are connected to ground and +5 volts DC respectively. Resistor 598 is connected to power supply line 574 which includes resistor 602. The ratios of resistors 596, 598, and 600 are selected so that the voltage at each of the inlet pins of differential amplifier 588 is equal to the set oscillation point thereof, which causes the respective coil 566 to oscillate. The purpose of line 590 from line 586 to the microcomputer is to allow measurement of the oscillation frequency by the computer. There is also a self-induced magnetic field due to direct current in the coil 566. Depending on which gate is on, the direct current will add to or subtract from the earth's magnetic field, and the direction can be suitably calculated therefrom by microcomputer 524. Such a compass sensor may, for example, be of the type marketed by PNI Corporation of Santa Rosa, Calif. and described in U.S. Pat. Nos. 4,851,775 and 5,239,264, which are incorporated herein by reference.

A data output circuit 604 is connected to microcomputer 524 for use, if desired, for telemetry about battery life. Thus, receiver data line 554 is provided to receive telemetry data which has been received from the transmitter by the receiver 516 and to send the data to the microcomputer 524. Transistor 601 in the line 554 between the receiver 516 and the microcomputer 524, resister 603 in series therewith, and resisters 605 and 607 in parallel therewith are suitably arranged, using principles commonly known to those of ordinary skill in the art to which this invention pertains, to adapt the data from the receiver 516 into a form acceptable to the microcomputer 524.

Circuit 650 is connected to the microcomputer 524 via line 652 at pins 654 and 655 and to the PDA or display computer 508 via lines 606 and 607 to feed data to and from the direction finding (DF) unit 506 for providing compass and RSSI data to DF unit 506 via line 606, as previously described, and for other purposes as more specifically described hereinafter. Line 652 includes transistor 660 (provided to achieve electrical compatibility with the input requirements of display computer 508), resister 662 in series therewith between transistor 660 and pin 654, and a pair of resisters 664 and 666 in series with and between transistor 660 and pin 655. A resister 668 in parallel is connected to line 652 between transistor 660 and resister 662. Line 606 is connected to the line 652 at a point between the transistor 660 and resister 664, and line 607 is connected to the line 652 at a point between the resisters 664 and 666. These circuit elements are suitably selected and connected, in accordance with principles commonly known to those of ordinary skill in the art to which this invention pertains, to achieve the objectives described hereinafter.

Microcomputer terminal or pin 655 feeds data to the direction finding (DF) unit 506 for "stimulating" the DF unit 506. The DF unit 506 has no "power on/off" switch and normally "sleeps" to conserve battery power. When the display computer 508 turns on, it is programmed, as previously discussed, to send a message (any message will work) to pin 655 to "wake up" the DF unit 506 to energize all internal circuits required for normal (non-sleep) operation. The message is periodically re-transmitted by the display computer 508 to maintain the "on" condition of the DF circuits. If no message is detected by the DF unit for a period of approximately 5 seconds, the DF unit 506 "assumes" that the display computer 508 is turned "off," and it therefore turns off all internal DF circuits and returns to "sleep" mode to conserve battery life.

The signal produced by the display computer 508 at pin 655 normally consists of a negative voltage that periodically pulses to a positive voltage to indicate that the display computer 508 is turned on. The message from the DF unit 506 to the display computer 508 must also contain a negative voltage since this is required by the circuits inside the display computer 508. No source of negative voltage is provided by the DF unit 506 since such would increase the design complexity and reduce the battery life of the DF unit 506. Alternatively, the negative voltage that is generated by the display computer 508 on pin 655 is "robbed" or provided for use by resister 664 to provide the negative voltage for the DF output message.

Circuit 700 provides the power supply, comprising a 3.0 volt, nominal battery 701 (two AAA cells) and a 5 volt power supply integrated circuit (IC) 702 for the direction finder (DF) unit 506, the positive terminal of the battery 701 being connected to the IC pin 705 via line 703, and a capacitor 707 being in parallel with the battery 701. IC 702 is enabled or disabled by the microcomputer 524 via line 708 connecting IC terminal or pin 710 to microcomputer pin 712. A power supply switch includes diodes 704 and 706. A line 714, which contains diode 704, connects line 703 (hence connects IC pin 705 and battery 701) to microcomputer pin 716. A line 718, which contains diode 706, connects IC pins 720 to line 714 (hence to microcomputer pin 716). Grounded fixed and variable capacitors 722 and 724 respectively are disposed along line 718 between the IC 702 and the diode 706. Grounded fixed and variable capacitors 726 and 728 respectively are disposed along line 714 between the microcomputer 524 and the diodes 704 and 706. A line 730, which contains a resistor 732 and which has grounded fixed and variable capacitors 734 and 736, connects line 718 at a point between the capacitors 722 and 724 (hence connects IC pins 720) with microcomputer pin 738.

The power supply IC 702 accepts an input voltage at pin 705 from battery 701 along line 703 which is as low as 1.8 volts DC and boosts the voltage by a factor of 3. The resulting voltage is then regulated down to about 5 volts DC, for use by the various circuits in the direction finding unit 506.

In order to allow continuous operation of the microcomputer 524 while the IC 702 is turned off (disabled via line 708), an alternative power source is provided by the diodes 704 and 706. When IC 702 is turned off, power to the microcomputer 524 is provided by diode 704 directly from the battery 701 along line 714 to microcomputer pin 716. When the microcomputer 524 is then turned on as a result of a stimulus from the display computer 508 detected on microcomputer pin 655, the microcomputer 524 enables the power supply IC 702 by driving microcomputer pin 712 to a positive voltage for delivery along line 708 to IC pin 710. Once the IC 702 is thus turned on, power for the microcomputer 524 is provided by IC pins 720 along line 718 containing diode 706 and to microcomputer pin 716.

The microcomputer 524 desirably will run down to a supply voltage as low as about 2 volts and as high as about 5 volts. While in "sleep" mode, the supply voltage is desirably about 2.5 volts from the battery 701 via line 714 to microcomputer pin 716. When IC 702 is enabled, the supply voltage therefrom at pins 720 along line 718 to microcomputer pin 716 is desirably about 4.5 volts. These voltages can be suitably designed into the power supply circuit 700 using principles commonly known to those of ordinary skill in the art to which this invention pertains. A second power supply input at microcomputer pin 738 from line 730 and IC pins 720, whose purpose is to provide separate power for the internal circuits of the microcomputer 524 that are only required to measure the RSSI signal, is only required when the direction finding unit is turned on, so it does not require any "sleep" power source. A suitable power supply IC 702 is one identified as TPS60140, sold by Texas Instruments of Dallas, Tex.

An RC circuit 750 (comprising a grounded resistor 752 and a grounded capacitor 754 in parallel and providing an input at microcomputer pin 756 along line 758) is provided as a power-on reset circuit, i.e., the circuit 750 provides a slight time delay between installation of the battery 701 and computer start-up.

The latch mechanism 514 and the connector 504, which is of a quick-disconnect type, allow the display computer 508 and the directional antenna 502 of the indicator or display assembly 500 to be easily detached from the direction finder unit 506 when the assembly 500 is not being used, thereby to facilitate storage and transportation. These connectors 504 and 514 are conventional items, a suitable connector 504 being, for example, a BNC connector marketed by Digikey Corporation of Thief River Falls, Minn., and a suitable connector 514 being, for example, part number 300-0187, marketed by Northstar Systems, Inc. of Rancho Cucamonga, Calif.

The sensitivity of the directional antenna 502 has various values depending on the direction of the transmitted signal in relation to the direction of the antenna 502. Maximum sensitivity occurs when the directional antenna 502 faces directly towards the radio transmitter 60. Minimum sensitivity occurs when the directional antenna 502 faces directly away from the radio transmitter 60. Intermediate directions will exhibit intermediate values of antenna sensitivity. Such a directional antenna may be one provided by Hygain Corporation of Starkville, Miss.

Figure 32:
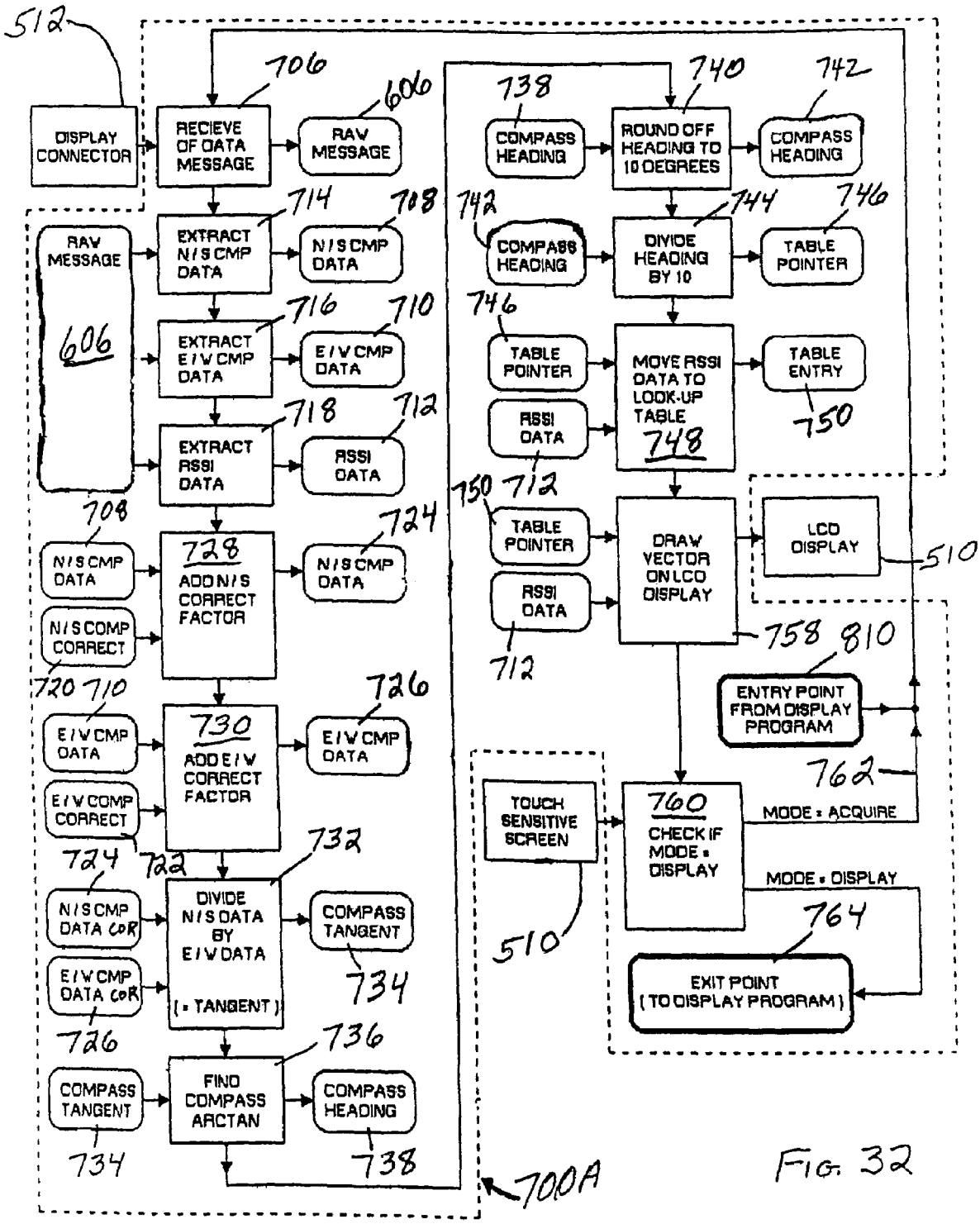
FIG. 32 is a software flow chart of a program in the acquire mode of operation for the receiver display computer.

The display computer 508 is a conventional item of consumer electronics typically called a PDA (personal digital assistant). The PDA 508 is modified by the present invention by the installation of a software program, illustrated at 700A and 700B in FIGS. 32 and 33 respectively, that enables its use as a display computer. Such a PDA may, for example, be one identified by no. M505 and marketed by Palm Corporation of Santa Clara, Calif.

Figure 33:
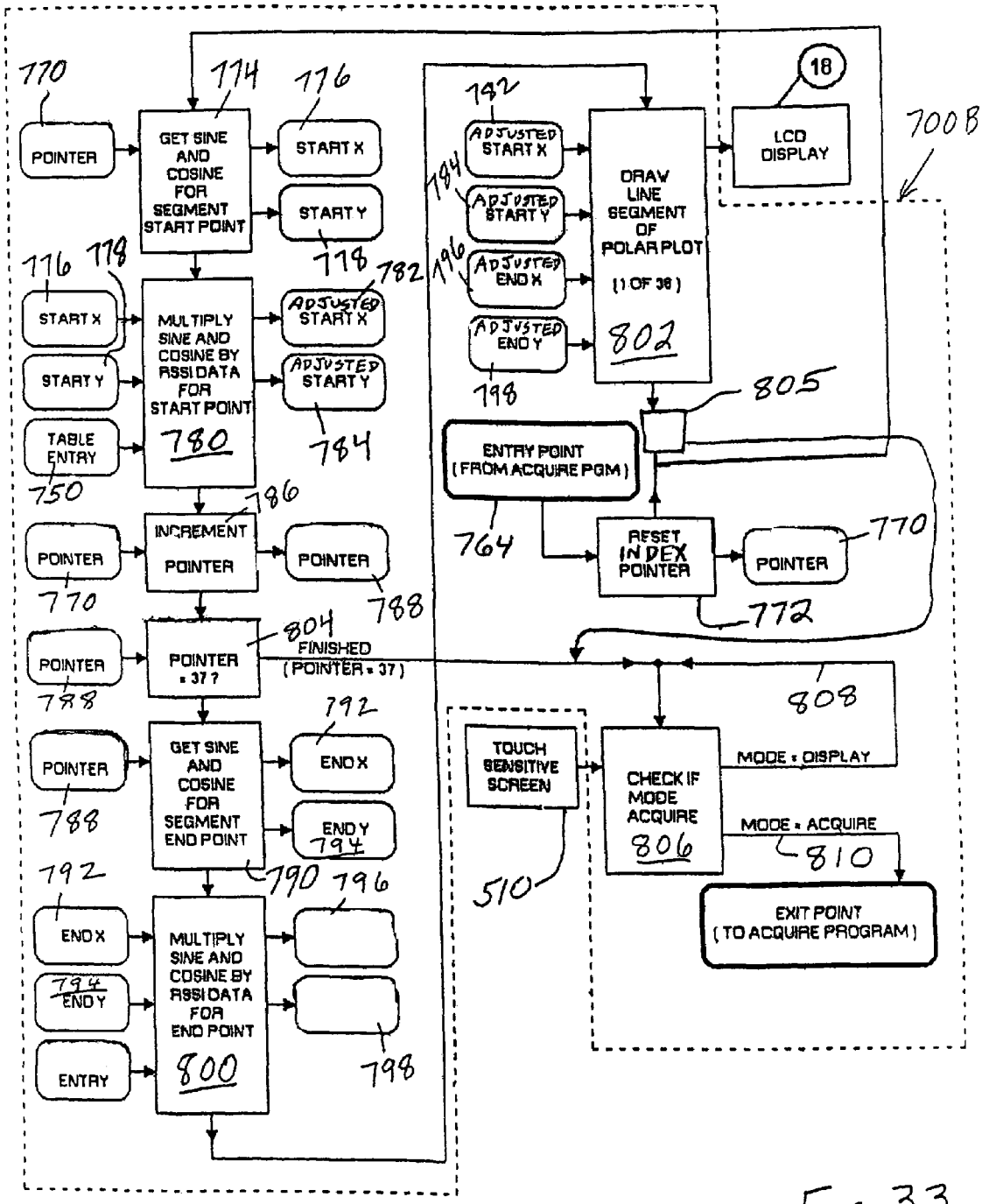
FIG. 33 is a software flow chart of the program of FIG. 32 in the display mode of operation.
Figure 34A:
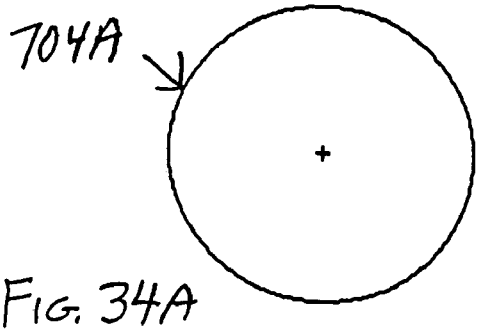
FIGS. 34A to 34D are typical patterns which illustrate the graphical visual display that is produced by the receiver display computer for various stages of progress (start, ⅓ complete, ⅔ complete, and completed respectively) in the acquire mode.
Figure 34B:
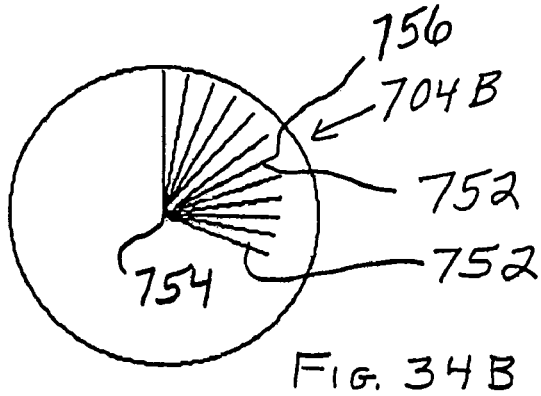
Figure 34C:
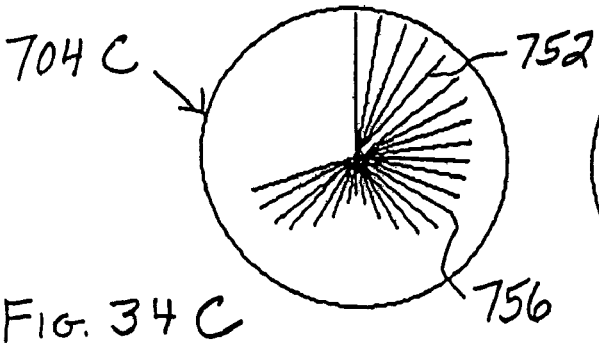
Figure 34D:
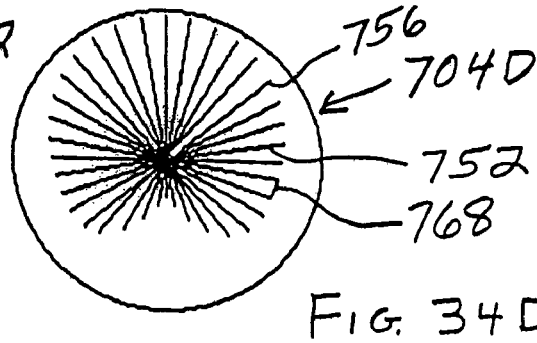
Figure 34E:
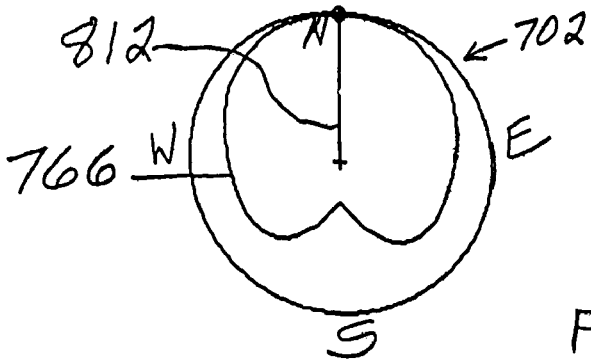
FIG. 34E is a typical pattern which illustrates the final graphical display which is generated when the display computer is switched from the acquire mode (in which the patterns of FIGS. 34A to 34D are produced) into the display mode of operation.

The display program 700 (includes 700A and 700B) that is installed in the display computer 508 accepts the message produced by the direction finder 506 and transmitted over line 606 and uses the data to generate a polar plot graphical display, illustrated at 702 in FIG. 34E. The display program 700 has two modes of operation, i.e., acquire mode, illustrated at 700A in FIG. 32, and display mode, illustrated at 700B in FIG. 33. The display program 700 uses the touch-sensitive screen 510 in the PDA 508 to switch between these two modes of operation.

In the acquire mode 700A, the display program stores data about signal strength and signal direction at various directional orientations of the antenna 502 until enough information is obtained to generate the complete polar plot display 702. During the acquire mode 700A, the user must slowly rotate the display unit 500 through a 360-degree circle to allow acquisition of this data. FIGS. 34A, 34B, 34C, and 34D illustrate generally at 704A, 704B, 704C, and 704D respectively acquire displays at various stages (start, ⅓ complete, ⅔ complete, and completed) in the progress of performing the 360-degree rotation.

In the display mode 700B, the data obtained during the acquire mode 700A is analyzed and used to generate the complete 360-degree polar plot graphical display 702 (FIG. 34E). After receipt of the data message 606 from the direction finder 506, as illustrated at 706, the message 606 is broken down to extract the North-South compass sensor data 708, the East-West compass sensor data 710, and the RSSI data 712, as indicated at 714, 716, and 718 respectively. In order to correct for errors caused by the proximity of magnetic materials that may be used in the display computer 508 and the direction finder 506, numerical correction factors, illustrated at 720 and 722, are applied to the North-South compass sensor data 708 and the East-West compass sensor data 710 respectively to obtain corrected North-South compass sensor data 724 and the East-West compass sensor data 726, as illustrated at 728 and 730 respectively. The corrected North-South compass sensor data 724 is then divided by the East-West compass sensor data 726, as illustrated at 732, to yield a numeric value equal to the tangent of the compass heading, illustrated at 734. The arctangent is then calculated, as illustrated at 736, to obtain the actual compass heading, illustrated at 738, expressed in degrees. The compass heading 738 is then rounded off to the nearest 10 degree increment, as illustrated at 740. The resulting rounded off compass heading 742 is then divided by 10, as illustrated at 744, to yield a table pointer 746, i.e., a number ranging from 0 to 35.

In the acquire mode, the RSSI data 712 is stored in a numeric array of dimension 1×36. The compass number 746 (0 to 35) is now used to identify which element in the array should receive the RSSI data 712 contained in the message. Once the element is identified, the RSSI data 712 is moved to that array element, as illustrated at 748, thereby providing table entry 750.

The starting point for X and Y values for a vector, illustrated at 752 in FIGS. 34B, 34C, and 34D, representing the data contained in the message 606, are selected for the center, illustrated at 754 in FIG. 34B, of the screen 510. The North-South compass sensor data 708 and the East-West compass sensor data 710 are now each multiplied by the RSSI data 712 to re-scale the length of the vector 752 to be drawn and are further multiplied by a constant numeric value selected to ensure that the resulting vector length does not exceed the limits of the display screen 510 on the PDA 508. The values for the X and Y co-ordinates for the center of the screen 510 are then added to the resulting (re-scaled and magnitude corrected) North-South and East-West compass sensor values, and the resulting values are then used to define the end point, illustrated at 756 in FIGS. 34B, 34C, and 34D, for the vector 752 to be drawn on the screen 510. Now that the X and Y values for the starting and ending points 754 and 756 respectively of the vector are identified, the individual vector 752 for the individual message 606 is drawn by the program 700A on the graphical LCD display 510, as illustrated at 758, and this indicates to the user that readings have already been obtained for the particular compass bearing.

The acquire program 700A then checks to see if the touch-sensitive screen 510 has been activated, as illustrated at 760, which would indicate that the user wishes to switch to the display mode 700B. If no such activity has occurred, the acquire program 700A loops to the beginning, as illustrated at 762, and repeats the process for the next message 606 coming from the direction finder 506. If the screen 510 has been activated, the acquire program 700A exits to the display program 700B, as illustrated at 764 in FIGS. 32 and 33.

Referring to FIG. 33, the data previously stored in the 1×36 numeric array is now used to generate a complete polar plot graphical display, illustrated at 766 in FIG. 34E, of signal strength versus signal direction. This is achieved by drawing 36 individual line segments (one such line segment illustrated at 768 in FIG. 34D) each segment joining the tips 756 of two adjacent vectors 752.

The X and Y values for the starting and ending points (which are points 756 for two adjacent vectors 752) must be identified before each line segment 768 can be drawn on the screen 510 of the display computer 508. Once these points are identified, the line segment 768 can be drawn, and the display program 700B proceeds to the next line segment 768. This process is repeated for a total of 36 times, yielding 36 line segments 768 joining 37 vector points 756, resulting in the display line 766.

The display program 700B begins by resetting an index pointer 770, as illustrated at 772, to a value of zero, which then points to the RSSI value 712 (stored in the 1×36 array) for a compass heading of zero degrees. This is only performed once when the display program 700B begins.

The index value 770 is used to calculate the sine and cosine of 0 degrees, as illustrated at 774, and these resulting values are stored in the values for starting X and starting Y, illustrated at 776 and 778 respectively, for the line segment yet to be drawn. These X and Y values are then multiplied by the RSSI value for 0 degrees (found in the 1×36 array) to adjust the radial distance from the center 754 of the screen 510 to the starting point 756 of the line segment 768. The starting point X and Y values 776 and 778 respectively are further multiplied by a constant numeric value selected to ensure the resulting vector length does not exceed the limits for the display screen 510 on the PDA 508. Then the X and Y co-ordinates for the center 754 of the screen 510 are added to the X and Y values for the starting point to translate them to their proper positions on the display screen 510, resulting in adjusted starting point X and Y co-ordinates 782 and 784 respectively for the particular line segment 768 now being identified.

The index value 770, which was 1, is now incremented, as illustrated at 786, to point to the next entry 788 in the 1×36 data array, i.e., a value of 2, with a compass heading of 10 degrees.

The incremented index value 788 is used to calculate the sine and cosine of the new compass heading (10 degrees), as illustrated at 790, and these values are stored as the values for ending X and ending Y, illustrated at 792 and 794 respectively, for the line segment 768 still to be drawn. These X and Y values 792 and 794 respectively are then multiplied by the RSSI value for the new index value 788 (in this case, 10 degrees) (found in the 1×36 array) to adjust the radial distance from the center 754 of the screen 510 to the ending point of the line segment 768. The ending point X and Y values 792 and 794 respectively are further multiplied by a constant numeric value selected to ensure that the resulting vector length does not exceed the limits of the display screen 510 on the PDA 508. Then the X and Y co-ordinates for the center 754 of the screen 510 are added to the X and Y values for the ending point to translate them to their proper positions on the display screen 510, as illustrated at 800, resulting in adjusted ending point X and Y co-ordinates 796 and 798 respectively for the particular line segment 768 now being identified.

Since the adjusted start and ending point X and Y co-ordinates have now been identified, the program 700B now draws the corresponding single line segment 768 connecting the tips 756 of the vectors 752 for, in this case, 0 and 10 degrees, as illustrated at 802.

The index pointer 770 is now tested to see if all 36 segments have been drawn, as illustrated at 805. If not, the program 700B loops to the beginning and repeats the process described above to draw the next line segment 768. This time (and during subsequent times) the index 770 is not re-set to zero and the process is repeated with a starting point of 10 degrees (20 degrees next time, etc.) instead of 0 degrees. The next iteration of the program loop therefore draws a line segment connecting the tips of the vectors for 10 and 20 degrees. This process is repeated 35 more times until the index value 770 equals a value of 36, indicating that all 36 line segments 768 have been drawn and the polar plot graphical display 766 is finished.

Once completion of the display 766 is completed, the display program 700B checks to see if the touch-sensitive screen 510 has been activated, as illustrated at 806, which would indicate that the user wishes to switch to the acquire mode 700A. If no such activity has occurred, the display program 700B loops endlessly, as illustrated at 808, waiting for an input to the touch-sensitive screen 510. There is no reason to repeat the drawing process since the hardware in the display computer 508 will retain the image 766 previously drawn indefinitely. If the screen 510 has been activated, the display program 700B exits to the acquire program 700A, as illustrated at 810 in FIGS. 32 and 33.

As seen in FIG. 34E, the pattern 766 of joined line segments 768 will indicate a direction in which the signal is the strongest. In FIG. 34E, the direction of greatest signal strength is indicated to be North, as illustrated at 812. The hunter 110 can then head in that direction looking for the deer 113 and, if need be, use the display unit 500 again until the deer is found.

Referring to FIG. 37, there is shown generally at 900 an alternative embodiment of the circuitry for the direction finding unit 506, which includes an alternative receiver 902 which employs a fully integrated 916 MHz receiver integrated circuit or chip 904, which may, for example, be one identified as part no. TDA5212, sold by Infineon Corp. of San Jose, Calif. By "fully integrated" is meant that a single silicon chip comprises the entire receiver, without the need for additional chips or semiconductors to achieve a working receiver, although additional chips or semiconductors may be employed to enhance its performance. This receiver 902 is a single conversion superhetrodyne type with a 10.7 MHz intermediate frequency and high-side injection of a crystal controlled local oscillator. The local oscillator employs a phase-locked-loop which multiplies the crystal frequency of 14.484375 MHz by a factor of 64 to achieve a final local oscillator frequency of 927.00 MHz. This local oscillator signal is then mixed with the transmitter signal (after amplification, as discussed hereinafter) which operates at a transmitter frequency of 916.300 MHz. The result of the "mixing" yields the intermediate frequency signal of 10.7 MHz (927.00-916.30). The intermediate frequency signal is then passed through a 10.7 MHz quartz crystal filter, illustrated at 908, with a bandwidth of approximately 30 KHz to reduce the amount of noise present in the signal and thereby increase the receiver sensitivity. The 10.7 MHz intermediate frequency signal is then amplified by several amplifier stages inside the Infineon chip 904 to achieve an overall maximum signal sensitivity (measured at the antenna) of somewhere between −110 and −120 dbm (0.2 to 0.7 microvolts). The amplifier stages inside the Infineon chip 904 automatically generate the RSSI signal that is employed to drive the rest of the direction finding unit 506. The crystal controlled local oscillator, phase-locked-loop, mixer, intermediate frequency amplifier, and RSSI circuits are all contained inside the Infineon chip 904. The quartz crystal 906 (that determines the radio channel frequency) and the quartz crystal filter 908 (that determines the channel width) are external to the Infineon chip. Preferably, the receiver 902 includes a preamplifier integrated circuit or "low noise amplifier," illustrated at 910, between the antenna 504 and the input to the infineon IC 904 to increase the operating range for the direction finding unit 900 (possibly as great as a mile or more) or provide increased reliability under adverse circumstances (such as a prey animal lying on top of the transmitter). A suitable chip for preamplifier IC 910 is part no. UPC8211TK, marketed by California Eastern Laboratories of Santa Clara, Calif. (North American sales and marketing partner of NEC Corporation. The preamplifier IC 910 utilizes a 3 volt power supply, which is provided by a 3 volt DC regulator integrated circuit 912. A suitable chip for IC 912 is part no. TPS76030, marketed by Digikey Corporation of Thief River Falls, Minn. The receiver 516 (FIG. 24) may also be provided with such a preamplifier IC. The direction finding unit 900 as described above and as illustrated in FIG. 37 may be made and used by one of ordinary skill in the art to which this invention pertains using principles commonly known to those of ordinary skill in the art to which this invention pertains.

Appended hereto and incorporated herein by reference are copies of the source code for certain programs as follows. The code for the program for the "loop" transmitter microcomputer 402 (FIG. 23) is labeled "G2A_LP.asm" and comprises 3 sheets. The code for the program for the "fishhook" transmitter microcomputer 308 (FIG. 22) is labeled "Arrow Transmitter Program" and comprises 2 sheets. By inspection thereof, it can be seen that the code for this program is written to be identical (or substantially identical) to the aforementioned "loop" transmitter program labeled "G2A_LP.asm", i.e., the same code is provided for both the "loop" and "fishhook" transmitters. The code for the program for the direction-finder microcomputer 524 is labeled "PF__50A.asm" and comprises 17 sheets. The above programs are written in PIC Assembly language. A suitable IBM program to employ the above programs is the PIC IDE (integrated Development Environment) and PIC ASM assembler, available at the website: http://www.microchip-.com/. The code for the PDA display program 700A and 700B (FIGS. 32 and 33 respectively) is labeled "Pda" and comprises 32 sheets. This program is written in NSBasic for Palm. A suitable IBM program to employ it is the NSBasic for Palm IDE which is available at http://www.nsbasic.com/palm/.

It should be understood that, while the present invention has been described in detail herein, the invention can be embodied otherwise without departing from the principles thereof. For example, while the preferred embodiment of the present invention refers to 3 hooks or 3 point heads, it is envisioned that another number thereof may also be provided suitably symmetrically about the housing or that another number may be provided and symmetry and balance achieved in a different way. Such other embodiments are meant to come within the scope of the present invention as defined by the appended claims.

What is claimed is:

1. An assembly comprising a transmitter to be carried by an arrow for effecting attaching of said transmitter to an animal struck by the arrow, said transmitter adapted to transmit signals to a receiver for tracking the animal, the assembly further comprising a bushing in which a shank portion of the arrow is receivable for attachment of said bushing to the arrow, a housing for said transmitter which housing has a passage for receiving said bushing, said housing detachably attachable to said bushing so as to remain attached to the bushing during flight of the arrow and to detach from said bushing during impact of the arrow with the animal, and at least one member for attaching the housing to the animal.

2. An assembly according to claim 1 wherein the assembly is adapted to be weight balanced about the arrow.

3. An assembly according to claim 1 wherein the transmitter is dynamically balanced.

4. An assembly according to claim 1 wherein said bushing and said housing are composed of different materials.

5. An assembly according to claim 1 wherein said bushing is composed of a plastic material, and said housing is composed of a plastic material which is harder than said bushing material and which is impregnated with a lubricant.

6. An assembly according to claim 1 comprising three of said member, said housing having three symmetrically and circumferentially spaced bores in which are mounted said members respectively to face forwardly of said housing, said members having pointed ends respectively for penetrating the animal.

7. An assembly according to claim 1 wherein said bushing comprises a washer-shaped portion and a plurality of circumferentially spaced prongs which extend from said washer-shaped portion.

8. An assembly according to claim 1 further comprising at least one battery sized to last about an hour.

9. An assembly according to claim 1 further comprising two 3-volt batteries for supplying power to said transmitter, each of said batteries having a diameter of about 0.16 inch and a length of about 1 inch.

10. An assembly according to claim 1 further comprising a circular ring received on a forward end portion of said housing, and said at least one member is connected to said circular ring and supports a hook in position to penetrate the animal.

11. An assembly according to claim 1 further comprising a magnetic reed switch operable by a hand-carried magnet for activating said transmitter.

12. An assembly according to claim 1 further comprising means for pulsing said transmitter.

13. An assembly according to claim 1 further comprising a hand-held device including a receiver for receiving signals transmitted by said transmitter, and means for determining and displaying direction to the transmitted signals.

14. An assembly according to claim 13 further comprising a hand-held device including a receiver for receiving signals transmitted by said transmitter, a directional antenna, circuitry for periodically determining strength of the received signals at discrete times as the directional antenna is swept through directional orientations, circuitry for determining directional orientations of said directional antenna at said discrete times respectively, structure for generating a graphical display of signal strength versus signal direction indicative of which direction is the strongest thereby indicating the direction to the transmitter.

15. An assembly comprising a transmitter to be carried by an arrow for effecting attaching of said transmitter to an animal struck by the arrow, said transmitter adapted to transmit signals to a receiver for tracking the animal, the assembly further comprising a bushing in which a shank portion of the arrow is receivable for attachment thereof to the arrow and having a radially outer surface and a groove in and circumscribing said outer surface, a housing for said transmitter, said housing having an inner surface adapted to circumscribe said bushing outer surface adjacent said groove, an elastomeric ring removably receivable in said groove and having a size and strength to hold said housing on said bushing during flight of the arrow and to dislodge from said groove and thereby release said housing from said bushing during impact of the arrow with the animal, and at least one member for attaching the housing to the animal.

16. An assembly according to claim 15 wherein said groove has a depth of between about 0.2 and 0.3 inch and wherein said elastomeric ring has a modulus of elasticity of between about Durometer 65 and 75 and has a diameter of between about 0.4 and 0.6 inch.

17. A hand-held direction finding device for detecting the direction to a transmitter attached to an animal for determining location of the animal, the device comprising a receiver for receiving signals transmitted by the transmitter, a directional antenna, circuitry for periodically determining strength of the received signals at discrete times as the directional antenna is swept through directional orientations, circuitry for determining directional orientations of said directional antenna at said discrete times respectively, structure for generating a graphical display of signal strength versus signal direction for each of a plurality of the directional orientations, the direction in which the signal strength is the strongest thereby indicating the direction to the transmitter.

18. A device according to claim 17 further comprising, in combination therewith, a transmitter detachably attachable to an arrow to be carried by the arrow during flight of the arrow and to be detachable from the arrow upon impact of the arrow with an animal, a member for effecting attaching of said transmitter to the animal, said transmitter adapted to transmit signals to said receiver for tracking the animal.

19. A device according to claim 17 wherein said graphical display generating structure comprises structure for generating a polar plot graphical display of signal strength versus signal direction.

20. A device according to claim 17 wherein said receiver comprises a fully integrated chip.

* * * * *